US011174117B2

(12) United States Patent
Wakefield et al.

(10) Patent No.: US 11,174,117 B2
(45) Date of Patent: Nov. 16, 2021

(54) APPARATUS AND METHOD FOR SPLICING MATERIAL ROLLS

(71) Applicant: Curt G. Joa, Inc., Sheboygan Falls, WI (US)

(72) Inventors: Ricky A. Wakefield, Sheboygan Falls, WI (US); Sean P. Follen, Cedar Grove, WI (US); Donald R. Dodelin, Woodstock, GA (US); Jeffrey W. Fritz, Plymouth, WI (US)

(73) Assignee: Curt G. Joa, Inc., Sheboygan Falls, WI (US)

( * ) Notice: Subject to any disclaimer, the term of this patent is extended or adjusted under 35 U.S.C. 154(b) by 77 days.

(21) Appl. No.: 16/574,195

(22) Filed: Sep. 18, 2019

(65) Prior Publication Data

US 2020/0087093 A1 Mar. 19, 2020

Related U.S. Application Data

(60) Provisional application No. 62/733,349, filed on Sep. 19, 2018, provisional application No. 62/868,293, filed on Jun. 28, 2019.

(51) Int. Cl.
*B65H 19/18* (2006.01)
*B65H 21/00* (2006.01)

(52) U.S. Cl.
CPC ..... *B65H 19/1821* (2013.01); *B65H 21/00* (2013.01); *B65H 2701/19* (2013.01)

(58) Field of Classification Search
CPC .. B65H 21/00; B65H 16/021; B65H 2701/19; B65H 2402/64; B65H 19/1821;
(Continued)

(56) References Cited

U.S. PATENT DOCUMENTS 2,260,830 A * 10/1941 Cline ..... B65H 19/1821 242/554.3
3,306,546 A 2/1967 Ryan
(Continued)

FOREIGN PATENT DOCUMENTS

DE 2023100 A1 12/1971
DE 2331125 B1 8/1974
(Continued)

*Primary Examiner* — William A. Rivera
(74) *Attorney, Agent, or Firm* — Ziolkowski Patent Solutions Group, SC

(57) ABSTRACT

A web splicing apparatus is disclosed that includes a web unwinding unit configured to hold a running web material roll and a new web material roll and to unwind webbing from the running web material roll and a web splicing unit operable with the web unwinding unit to selectively splice the webbing of the running web material roll with webbing of the new web material roll. The web splicing unit further includes a cutting assembly configured to selectively sever the webbing of the running web material roll, a web deflection device, an actuator system configured to linearly translate the web deflection device in a first direction and a second direction opposite the first direction, and a locking mechanism operable in a locked state and an unlocked state to selectively prohibit and enable movement of the web deflection device in the first direction and the second direction.

20 Claims, 18 Drawing Sheets

(58) Field of Classification Search
CPC .... B65H 19/14; B65H 19/18; B65H 19/1852; B65H 19/20; B65H 2408/22; B65H 2408/221; B65H 2301/4139; B65H 2301/412845; B65H 2301/463; B65H 2301/4601; B65H 2301/46; B65H 2301/4602
See application file for complete search history.

(56) References Cited

U.S. PATENT DOCUMENTS 3,460,775 A 8/1969 Ford et al.
3,655,143 A 4/1972 Wallis
4,190,483 A * 2/1980 Ryan ..... B65H 19/1852 156/504
4,219,378 A * 8/1980 Marschke ..... B65H 19/1852 156/157
4,455,190 A * 6/1984 Bianchetto ..... B65H 19/1852 156/504
5,360,181 A 11/1994 Hayashi et al.
5,562,038 A * 10/1996 Bierbaum ..... B65H 19/1873 101/483
6,325,324 B1 * 12/2001 Getz ..... B65H 19/1852 242/555.2
6,701,992 B1 * 3/2004 Pasquale ..... B65H 21/00 156/304.1
2005/0279461 A1 * 12/2005 Adami ..... B65H 19/1863 156/502
2006/0169826 A1 * 8/2006 Benvenuti ..... B65H 19/1863 242/552
2014/0326822 A1 * 11/2014 Morelli ..... B65H 16/106 242/555.3
2017/0088380 A1 * 3/2017 Mark ..... B65H 19/1852
2017/0137251 A1 * 5/2017 Sato ..... B65H 20/16
2017/0297849 A1 * 10/2017 Gnan ..... B65H 23/10

FOREIGN PATENT DOCUMENTS

DE 3530919 A1 4/1986
EP 0049376 A1 4/1982
EP 2062841 A1 5/2009

* cited by examiner

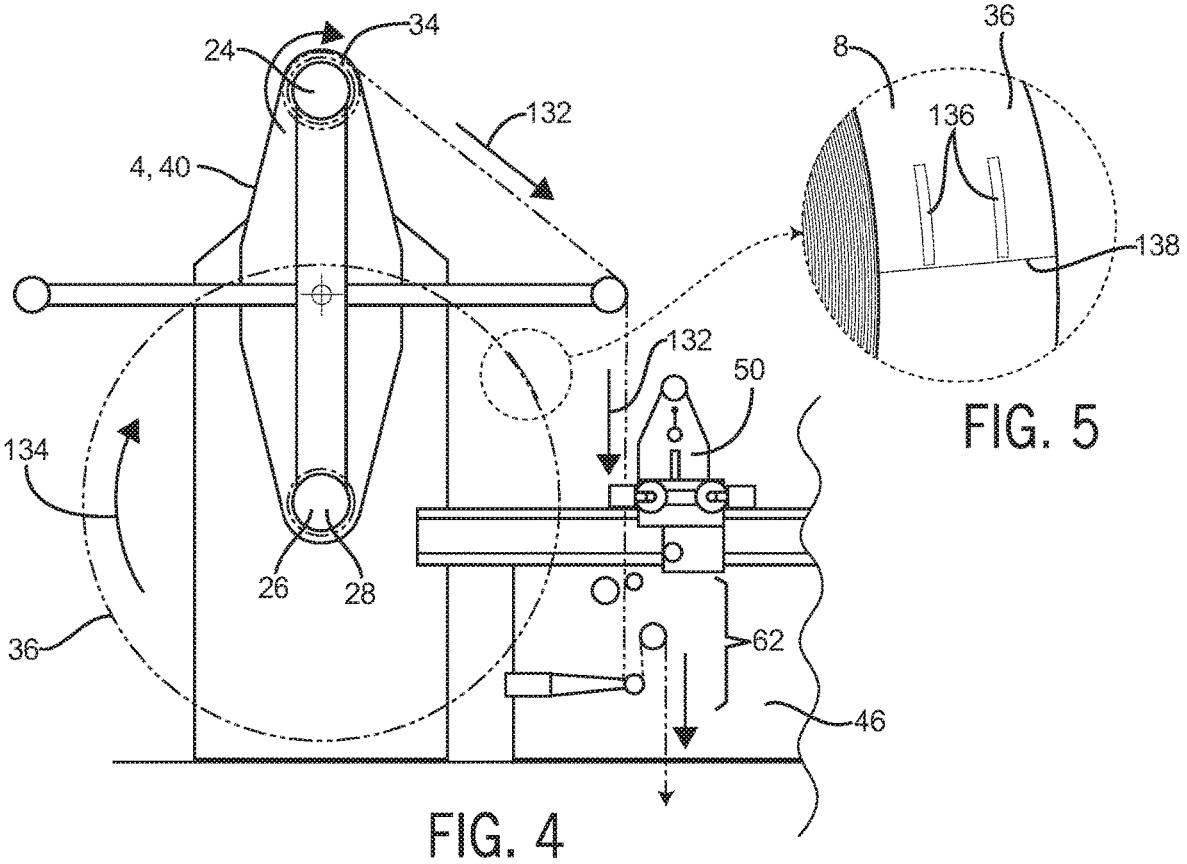
FIG. 5
FIG. 4
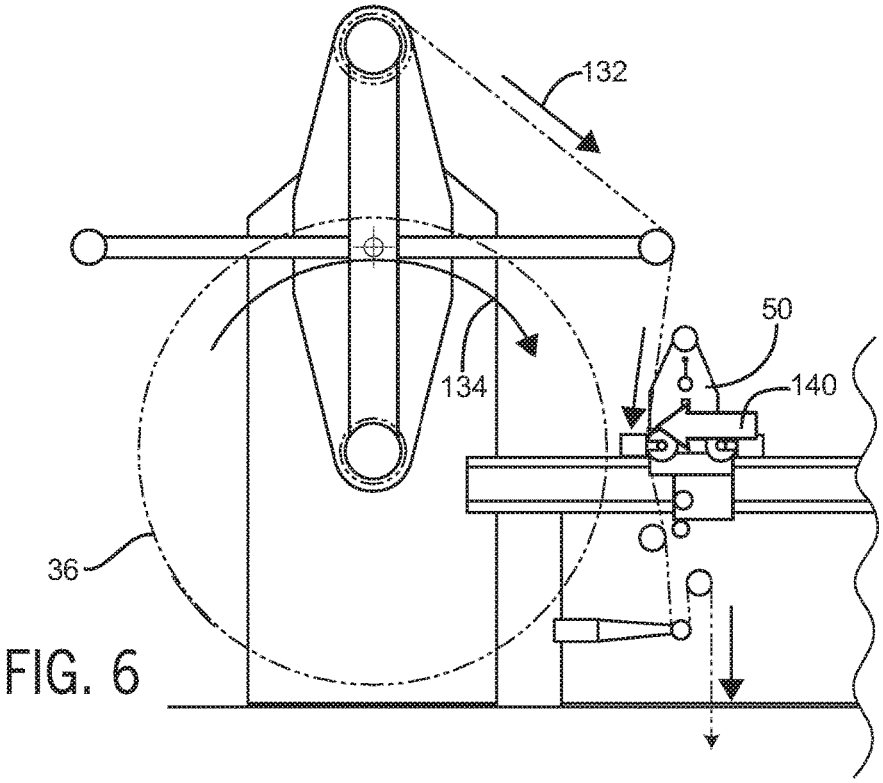
FIG. 6

APPARATUS AND METHOD FOR SPLICING MATERIAL ROLLS

CROSS-REFERENCE TO RELATED APPLICATIONS

The present invention is a non-provisional of and claims priority to U.S. Provisional Patent Application Ser. No. 62/733,349, filed Sep. 19, 2018, and to U.S. Provisional Patent Application Ser. No. 62/868,293, filed Jun. 28, 2019, the disclosures of which are incorporated herein by reference in their entirety.

BACKGROUND OF THE INVENTION

The present invention relates generally to an apparatus and method for making disposable garments and, more specifically, to an apparatus and method for the splicing of material rolls that provide the webbing used in the manufacture of a disposable garment assembly or absorbent sanitary product.

Generally, disposable garment assemblies or absorbent sanitary products such as diapers comprise an absorbent insert or patch and a chassis that, when worn, supports the insert proximate a wearer's body. Additionally, diapers may include other various patches, such as tape tab patches, reusable fasteners, and the like. The raw materials used in forming a representative insert are typically cellulose pulp, tissue paper, poly, nonwoven web, acquisition, and elastic, although application specific materials are sometimes utilized.

Typically, most of the raw materials used in the insert and/or chassis—such as web materials—are provided in roll form and unwound and applied in a continuously fed fashion. Usage and application of the web to a disposable garment assembly thus involves the unwinding of a roll of web material. In the prior art, web unwinding units exist that provide for the unwinding of a first or running web roll of material and for the positioning of a second or new roll of material that may be spliced with the running web roll as the running web roll nears expiration. At or near the expiration of the running web roll of web material, the web material on the running web roll is spliced with the web material on the new web roll—with the engagement of the web material on the new web roll occurring by splicing the webbing exiting the unwinding running web roll thereto. After splicing the web materials, the running web roll expires and the new web roll is unwound to continue feeding webbing into the disposable garment assembly.

In existing systems and methods for performing such splicing of material rolls, the splicing is performed using an arm assembly having a first end and a second end. The arm assembly is positioned downstream of a web unwinding unit that includes a first spindle and a second spindle, with webbing material being unwound from a running web roll that rotates about a first spindle while a new web roll is present on the second spindle. The arm assembly possesses rollers for which the webbing traverses along towards the disposable garment assembly. At a point in time, dependent on the amount of webbing material on the running (and now expiring) web roll, the arm assembly pivots or rotates about the first end, such that the second end of the arm assembly moves towards the web unwinding unit. The new web roll is in close proximity to the second end of the arm assembly when the second end of the arm assembly is pivoted towards the web unwinding unit.

At a point in time, in synchronicity with the rotating new web roll, the second end of the arm assembly accelerates towards the rotating new web roll. The acceleration of the second end of the arm assembly causes the unwinding webbing from the running roll of webbing to contact a predetermined area on the new web roll. The contact causes the webbing that is unwinding from the expiring web roll to break. The downstream section, created on the break of the webbing from the expiring web roll, connects to the downstream section of the new roll of webbing, rotating in the standby position. The new web roll then proceeds to unwind webbing towards the disposable garment assembly, with the arm assembly rotating about the first end to return to the unwind position. The new web roll rotates to the unwind position of the unwinding assembly and, in-turn, the expired web roll is rotated to the standby position. The expired web roll is removed and a subsequent new web roll is provided to the apparatus.

Several limitations or drawbacks are associated with the operation of the prior art arm assembly and web unwinding unit described above. First, the break action of the arm assembly may be overly aggressive when splicing web material from the expiring web roll to the new web roll, thereby causing destabilizing vibrations to reverberate through the apparatus. Second, the arm assembly may undergo a kickback or rebound upon bringing web material from the expiring web roll into contact with web material from the new web roll, thereby preventing a reliable slicing of the materials. Still further, the arm assembly provides for the breaking of webbing from only one web unwinding unit and/or allows for splicing of web rolls in only a single webbing line—i.e., it does not provide for the ability to splice web rolls of multiple webbing lines.

Therefore, a need exists for an apparatus and method that allows for splicing of web rolls in multiple web roll lines. The apparatus and method should perform such splicing in a manner that minimizes and/or accounts for destabilizing vibrations and kickbacks that might be associated with splicing web material from the expiring web roll to the new web roll.

BRIEF DESCRIPTION OF THE INVENTION

In accordance with one aspect of the invention, a web splicing apparatus includes a web unwinding unit configured to hold a running web material roll and a new web material roll and to unwind webbing from the running web material roll. The web splicing apparatus also includes a web splicing unit operable with the web unwinding unit to selectively splice the webbing of the running web material roll with webbing of the new web material roll, with the web splicing unit further comprising a cutting assembly configured to selectively sever the webbing of the running web material roll, a web deflection device, an actuator system configured to linearly translate the web deflection device in a first direction and a second direction opposite the first direction, and a locking mechanism operable in a locked state and an unlocked state to selectively prohibit and enable movement of the web deflection device in the first direction and the second direction.

In accordance with another aspect of the invention, a method for splicing webbing of a running web material roll with webbing of a new web material roll is provided. The method includes positioning a web splicing unit in proximity to the running web material roll and the new web material roll, severing webbing of the running web material roll with a cutting assembly of the web splicing unit, and bringing a web deflection device of the web splicing unit into contact with the new web material roll to cause a section of the webbing of the running web material roll to splice with webbing of the new web material roll. In bringing the web deflection device into contact with the new web material roll, the method further comprises operating a locking mechanism of the web splicing unit to allow movement of the web deflection device in a first direction toward the new web material roll and inhibit movement of the web deflection device in a second direction away from the new web material roll and operating an actuator system of the web splicing unit to cause the web deflection device to move in the first direction, so as to bring the web deflection device into contact with the new web material roll, wherein the locking mechanism prevents movement of the web deflection device in a second direction away the new web material roll to prevent a recoil of the web deflection device away from the new web material roll.

In accordance with yet another aspect of the invention, a web splicing unit operable with a web unwinding unit to enable splicing of webbing of a running web material roll with webbing of a new web material roll is provided. The web splicing unit includes a frame, a cutting assembly configured to sever the webbing of the running web material roll, a carriage apparatus coupled to the frame, the carriage apparatus carrying a web deflection unit, an actuator system configured to linearly translate the web deflection unit along the frame in a first direction and a second direction opposite the first direction, and at least one locking mechanism operable in a locked state and an unlocked state to selectively prohibit and enable movement of the web deflection unit in the first direction and the second direction.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings:

FIG. 4 is a side view of a portion of the web splicing apparatus of FIG. 1 that depicts how the web splicing apparatus is operated to unwind webbing from a running web roll.

FIG. 5 is a detail view of adhesive areas provided on a new web roll.

FIG. 6 depicts the web splicing unit of FIG. 1 advancing toward the webbing being unwound from the running web roll of a first web unwinding unit.

DETAILED DESCRIPTION

Embodiments of the present invention provide for a method and apparatus for splicing the webbing of material rolls used in the manufacture of a disposable garment assembly or absorbent sanitary product. A web splicing unit is operated to translate one or more web deflection devices thereof relative to webbing of the material rolls, so as to selectively splice webbing from a running material roll that is expiring with the webbing from a new material roll. The web splicing unit is constructed in a manner that creates splices while preventing a kickback or recoil of the web deflection device relative to the new material roll, thereby splicing the webbing in a consistent and reliable manner.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
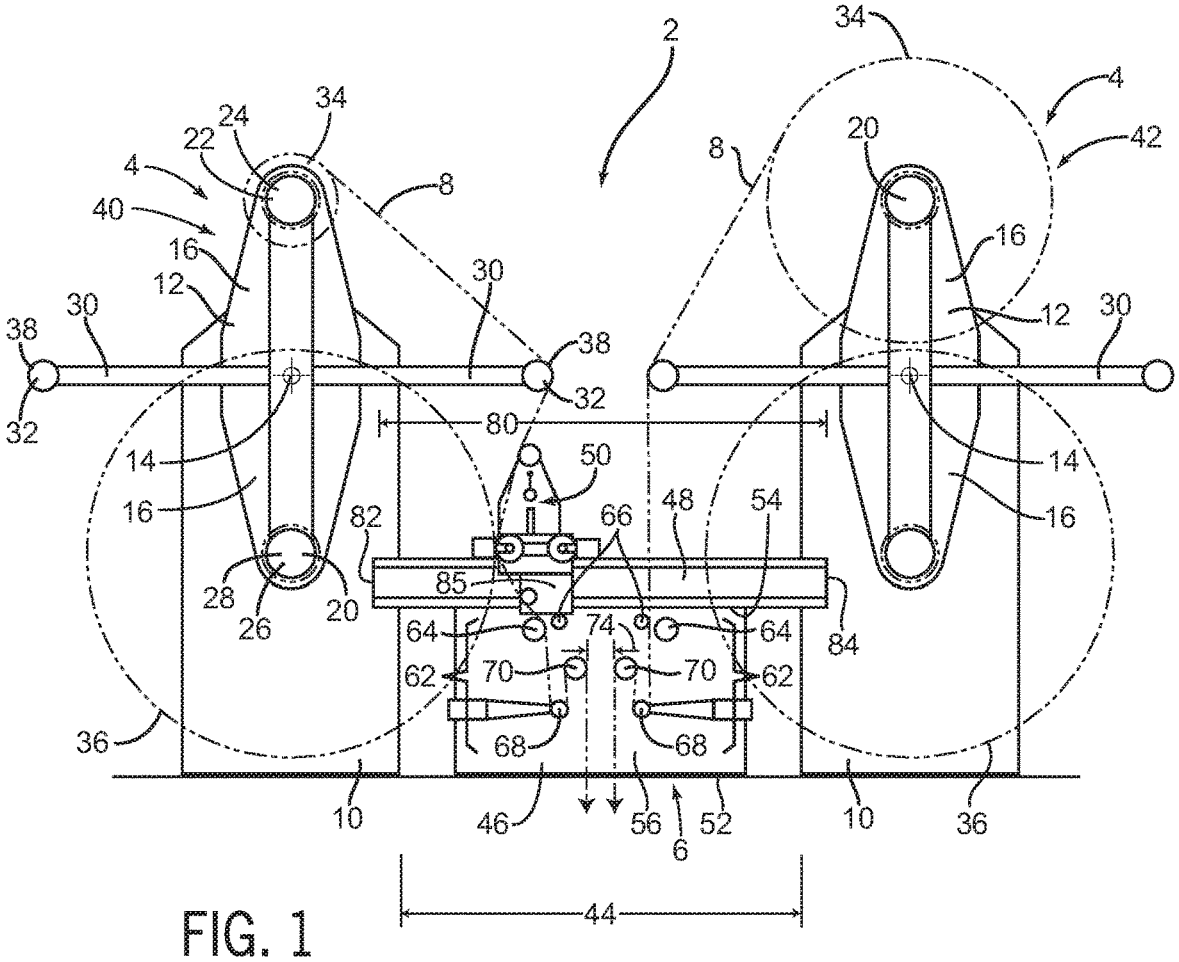
FIG. 1 is a side view of a web splicing apparatus that includes a web splicing unit mounted on a track and configured to splice running web rolls with new web rolls according to embodiments of the present invention.

With attention to FIG. 1, a side view of a web splicing apparatus 2 is illustrated according to an embodiment of the present invention. The web splicing apparatus 2 includes at least one web unwinding unit 4 (two web unwinding units in the illustrated embodiment) and a web splicing assembly 6 in close proximity to one another. The web splicing assembly 6 splices webbing 8 that is unwound by the unwinding unit(s) 4, in the manner described in detail below. The web unwinding units 4 may be of a known construction and may each include a web unwinding unit base 10 in rotational communication with a web unwinding unit mount 12 about an axis 14. In the illustrated embodiment, web unwinding unit mount 12 includes a first pair of arms 16 extending from the axis 14 in opposing directions. A spindle 20 is located near the apex of each arm 16, with a first spindle 22 located in a first or unwind position 24 and a second spindle 26 located in a second or standby position 28. A second pair of arms 30 extend from axis 14 in opposing directions that are substantially perpendicular to the first pair of arms 16. Each respective arm 30 extends from the axis 14 to a side, and a second arm roller attachment 32 is in rotational communication with the side of each second arm 30. The running web roll 34 rotates about the first spindle 24 and the new web roll 36 rotates about the second spindle 26. Initial operation of the web unwinding unit 4 provides for the running web roll 34 in the unwind position 24 to be unwound, where the unwound webbing 8 travels substantially about a circumference 38 of the second arm roller attachment 32 and toward the web splicing assembly 6.

As illustrated in FIG. 1, according to one embodiment, the web splicing apparatus 2 includes a pair of web unwinding units 4—first web unwinding unit 40 and a second web unwinding unit 42—between which the web splicing assembly 6 is positioned. The first web unwinding unit 40 and the second web unwinding unit 42 are preferably positioned a distance 44 from one another that provides for positioning of web splicing assembly 6 therebetween and are oriented such that the rotation of the web winding unit mount 12 of the first web unwinding unit 40 is at least substantially parallel to the rotation of the web winding unit mount 12 of the second web unwinding unit 42. While web splicing assembly 6 is described here below as configured/constructed for use with a web splicing apparatus 2 that includes both a first web unwinding unit 40 and a second web unwinding unit 42, it is recognized that web splicing assembly 6 could alternatively be configured/constructed for use with a web splicing apparatus 2 that includes only a single web unwinding unit 4.

Figure 2:
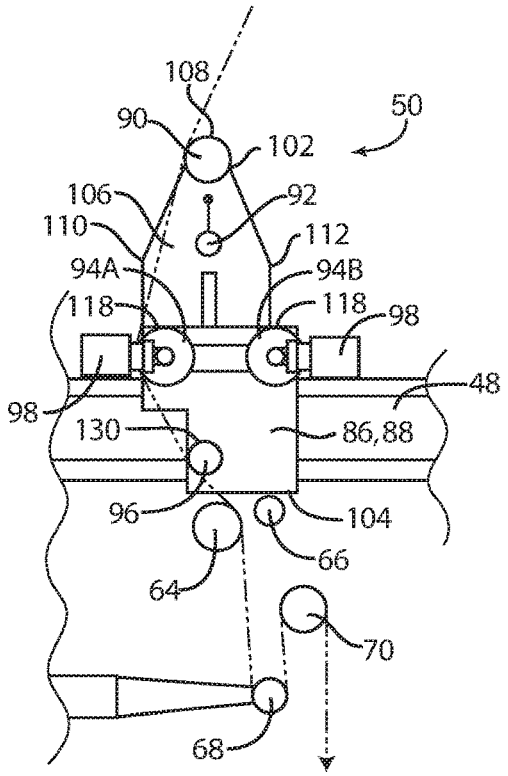
FIG. 2 is a side view of the web splicing unit of FIG. 1 according to an embodiment of the present invention.
Figure 3:
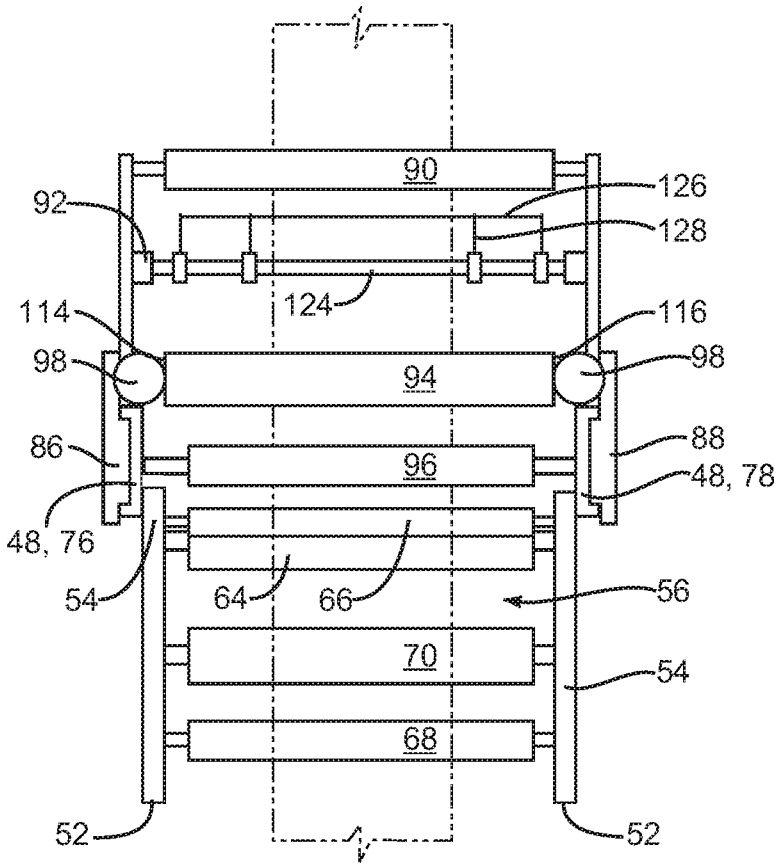
FIG. 3 is a front view of the web splicing unit of FIG. 1.

Referring still to FIG. 1 and now also to FIGS. 2 and 3, the web splicing assembly 6 comprises a base structure 46, a rail assembly 48, and a web splicing unit 50. The base structure 46 comprises a base structure first side 52 and an opposite base structure second side 54 separated by a cavity 56, as illustrated in FIG. 3. Positioned in the cavity 56 is a series of guide rollers 62 that, according to the illustrated embodiment, includes rollers 64, 66, 68, 70, although the series of guide rollers 62 could include a greater or lesser number of rollers. The base structure 46 may provide two series of guide rollers 62 separated at least by a distance 74, with each series of guide rollers 62 corresponding a respective one of the first and second unwinding units 40, 42.

As illustrated in FIG. 3, the rail assembly 48 includes a first rail assembly 76 and a second rail assembly 78. The first rail assembly 76 and second rail assembly 78 each extends a rail assembly length 80 (FIG. 1) that is defined by a rail assembly first end 82 and an oppositely opposed rail assembly second end 84, which are in close proximity to the web unwinding unit 4. The web splicing unit 50 is in sliding communication with the first rail assembly 76 and second rail assembly 78 and may be translated there along by a splice unit drive 85 when transitioning between use with the first web unwinding unit 40 and the second web unwinding unit 42. Splice unit drive 85 may be a motor, pneumatic cylinder, hydraulic cylinder, air cylinder, rack and pinion actuator, and ball screw actuator, or any other known drive/actuating device.

As shown in detail in FIG. 2 and FIG. 3, web splicing unit 50 includes two splicing unit sections, a splicing unit first section or frame 86 and a splicing unit second section or frame 88, that are preferably in slidable communication with the first rail assembly 76 and second rail assembly 78. The web splicing unit 50 further also includes first guide roller 90, a cutting assembly 92, web deflection devices 94, second guide roller 96, and a drive or actuator system 98 comprising one or more drive units/actuators and preferably two drive units/actuators. Actuator system 98 may include any known type of drive unit or actuating device, including pneumatic cylinders, hydraulic cylinders, air cylinders, rack and pinion actuators, and ball screw actuators, as non-limiting examples.

In the illustrated embodiment, web deflection devices 94 are rotary devices configured to bump into and thus deflect webbing 8. Web deflection devices 94 are thus referred to hereinafter as bump rollers 94. In alternative embodiments, web deflection devices 94 may be any alternative structure capable of deflecting webbing 8 via contact therewith. As one non-limiting example, web deflection devices 94 may be a non-rotary and non-circular structures such as, for example moveable plates. Likewise, actuator system 98 is referred to hereafter as bump roll actuators 98 but may be configured to actuate alternative deflection devices in alternative embodiments.

Each of the splicing unit first section 86 and splicing unit second section 88 includes a first web splicing unit end 102 and an oppositely opposed second web splicing unit end 104 separated by a splicing unit section body 106. Each of the splicing unit sections 86, 88 is configured to slide along the first and second rail assemblies 76, 78 at the second web splicing unit end 104 thereof.

The first guide roller 90 is in rotational communication with the splicing unit first end 102 of the splicing unit first section 86 and the splicing unit second section 88. The first guide roller 90 has a first guide roller circumference 108 about which the webbing 8 travels from the web unwinding unit 4 and toward the cutting assembly 92 of the web splicing unit 50. A second guide roller 96 is proximate the second web splicing unit end 104 and preferably in rotational communication with the splicing unit first section 86 and the splicing unit second section 88. The second guide roller 96 has a second guide roller circumference 130 about which the webbing 8 travels from the bump roller 94 and towards the base structure 46.

Bump rollers 94A, 94B are in close proximity to the first and second rail assemblies 76, 78 and in close proximity to the splicing unit first and second sections 86, 88. Preferably a bump roller 94A is in close proximity to a splicing unit first side 110 and a bump roller 94B is in in close proximity to a splicing unit second side 112. Each bump roller 94A, 94B extends generally between the splicing unit first section 86 and the splicing unit second section 88 and has a length defined by a bump roller first end 114 and a bump roller second end 116. According to one embodiment, the length of each bump roller 94 may differ. As will be explained in greater detail below, each bump roller 94 may be selectively translated along a linear path by a bump roller actuator 98 positioned adjacent each of the bump roller first end 114 and at the bump roller second end 116.

Figure 14:
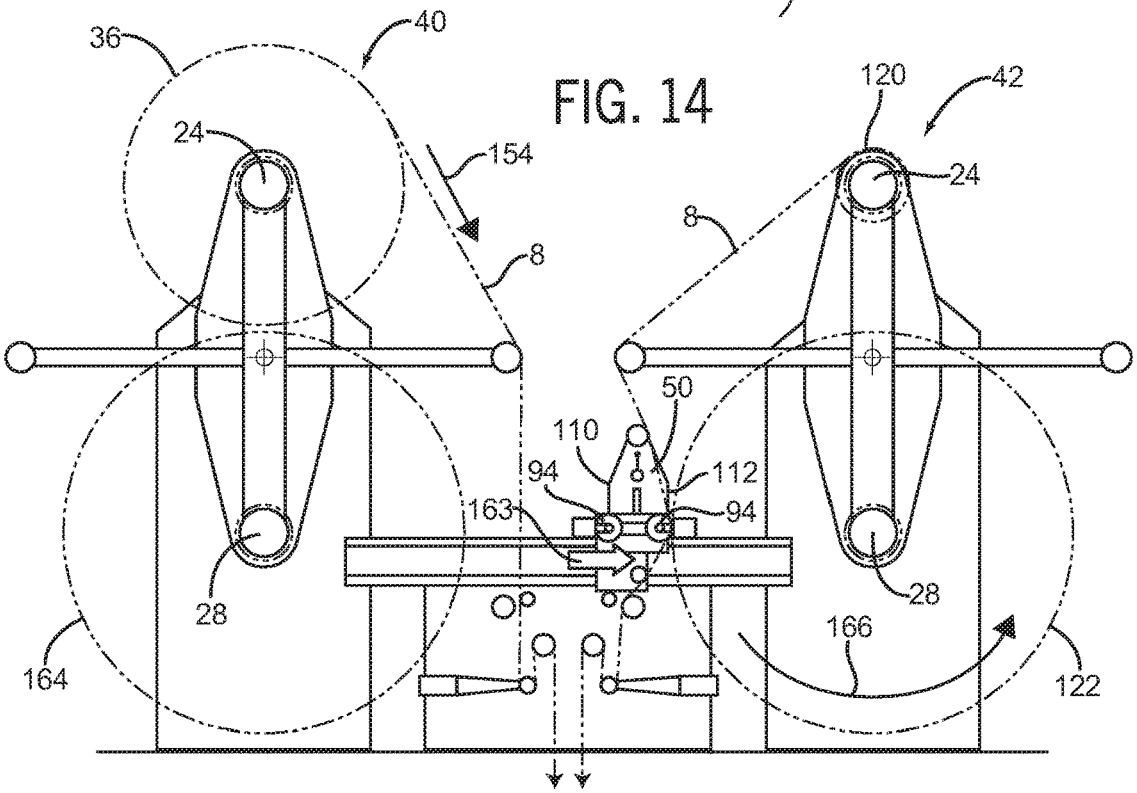
FIG. 14 illustrates the web splicing unit advancing toward a second web unwinding unit.

The bump roller actuators 98 cause bump rollers 94 to advance the webbing 8 of running web roll 34 toward the webbing 8 of new web roll 36 on the first web unwinding unit 40, so as to complete splicing of the webbing 8 between the running web roll 34 and the new web roll 36—with the webbing 8 traveling over a bump roller circumference 118 of the bump roller 94. Referring now to FIG. 14, the bump roller actuators 98 may also cause movement of bump rollers 94 in an opposite direction to advance the webbing 8 of running web roll 120 on second web unwinding unit 42 toward the webbing 8 of a new web roll 122 on the second web unwinding unit 42, so as to complete splicing of the webbing 8 between the running web roll 120 and the new web roll 122.

Referring again to FIGS. 2 and 3 and to the splicing of the running and new web rolls on the first web unwinding unit 40, the cutting assembly 92 is proximate the path of the webbing 8 of the running web roll 34. In the illustrated embodiment, the cutting assembly 92 includes a cutting wire 126 that is fixed to a support axle 124. Rotational communication between the support axle 124 and the first and second splicing unit sections 86, 88 providing for rotation of the at least one cutting wire 126. The cutting wire 126 is preferably attached to the support axle 124 via a connecting member 128. The support axle 124 rotates the cutting wire 126 in the direction of the bump roller 94 at a predetermined time interval. The rotation of the cutting wire 126 severs the webbing 8, separating the webbing 8 into two sections.

According to alternative embodiments, cutting assembly 92 may be configured to sever webbing 8 by alternate means such as via laser, air, water jet, or plasma as non-limiting examples. Cutting assembly 92 also may be located external to or independent from the mechanical frame components of web splicing unit 50 in alternative embodiments.

Referring now to FIG. 4-FIG. 14, and with continued reference to FIGS. 1-3, a method for operating the web splicing apparatus 2 is illustrated, according to an embodiment of the invention.

As illustrated in FIG. 4, webbing 8 is removed from a running web roll 34 of a web unwinding unit 4, 40 at a rate of removal 132, where the running web roll 34 is in a unwind position 24 and a new web roll 36 is in a standby position 28. The webbing 8 continues from the running web roll 34 to the series of guide rolls 62. The new web roll 36 is rotated about the second spindle 26 in the standby position 28 at an increasing rate of rotational speed 134 to cooperate with the rate of removal 132 of the webbing from the running (and now expiring) web roll 34. As illustrated in FIG. 5, the new web roll 36 includes at least one adhesive area 136 located at a downstream webbing section 138 of the webbing 8 contained in the new web roll 36.

As illustrated in FIG. 6, a web splicing unit 50 advances toward the webbing 8 being unwound from running web roll 34 in unwind position 24, as indicated at 140, with such advancement occurring via translation of web splicing unit 50 along rail assembly 48 by operation of splice unit drive 85 (FIG. 1), for example. The web splicing unit 50 advances toward the webbing unwinding from running web roll 34 in unwind position 24 at a determined interval based upon one of or a combination of: weight measurements of the running web roll 34, tension measurements of the webbing 8 removed from the running web roll 34, remote camera identification, and/or other forms of machine processing timing measurements. The webbing 8 continues from the running web roll 34 to the series of guide rolls 62 during this time.

Figure 7:
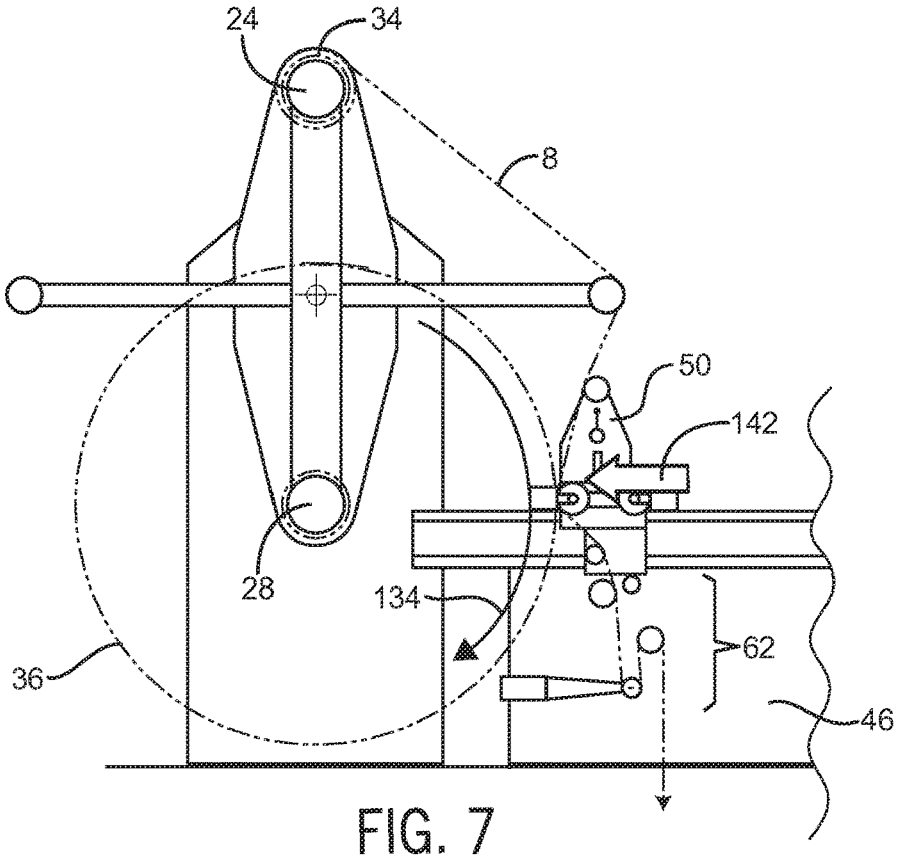
FIG. 7 depicts the web splicing unit of FIG. 1 further advancing to contact the webbing of the running web roll.
Figure 8:
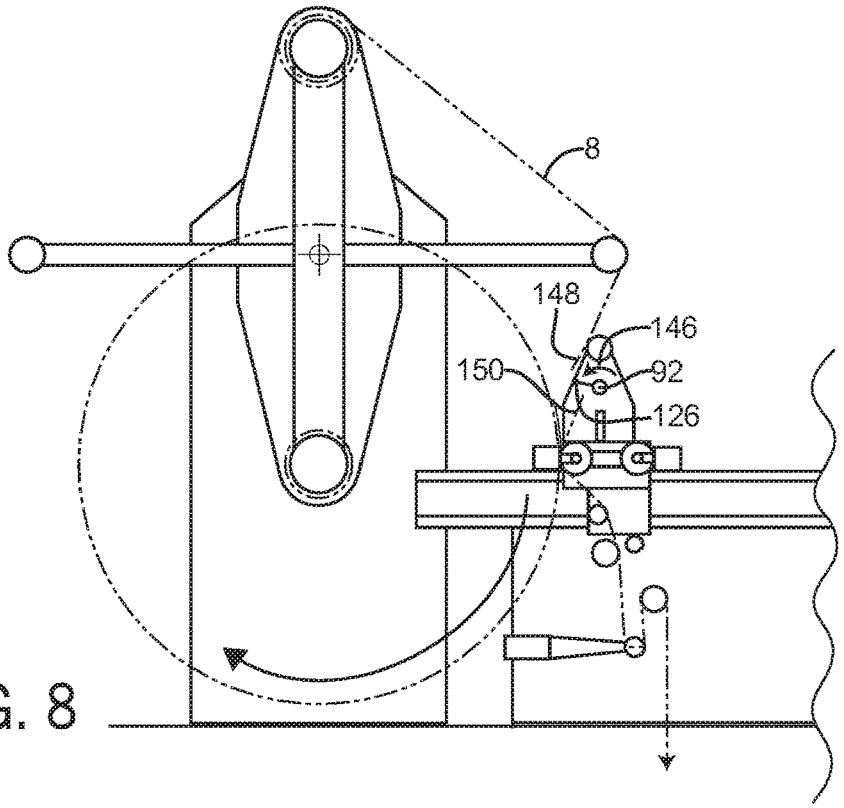
FIG. 8 depicts applying a cutting wire of the web splicing apparatus of FIG. 1 to the running web roll.

As illustrated in FIG. 7, the web splicing unit 50 continues advancing toward the webbing 8 and new web roll 36, and contacts the webbing 8 being removed from the running web roll 34, as indicated at 142. Next, the cutting assembly 92 is engaged at a predetermined time to rotate the cutting wire 126 toward and into the webbing 8, as indicated at 146 in FIG. 8. The rotation 146 of the cutting wire 126 toward and into the webbing 8 breaks the webbing 8, thereby forming an upstream webbing section 148 and a downstream webbing section 150.

Figure 9:
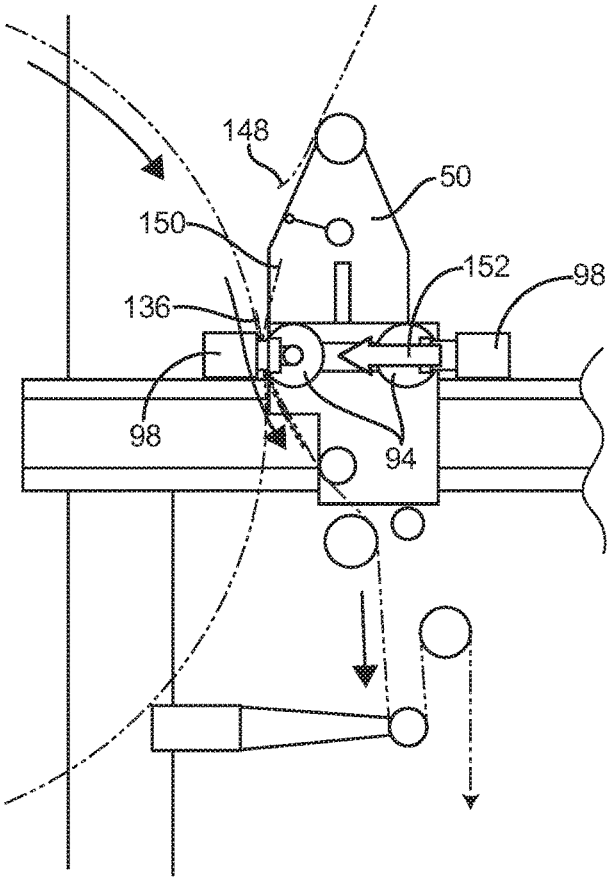
FIG. 9 illustrates adhering a downstream section of spliced webbing from the running web roll to a new web roll.

As illustrated in FIG. 9, bump roller actuators 98 are engaged, as indicated at 152. The engagement 152 of the bump roller actuators 98 pushes the downstream webbing section 150 of the webbing 8 from the running web roll 34 onto the adhesive area 136 on new web roll 36, so as to affix the downstream webbing section 150 to the downstream webbing section 138 of the webbing 8 contained in the new web roll 36. According to one embodiment, activation of the bump roller actuators 98 depends upon the location of the downstream webbing section 150 from the running web roll 34 and the new web roll 36 to the web splicing unit 50. According to another embodiment, the bump roller actuators 98 are activated independent of the location of the downstream webbing section 150 from the running web roll 34 and the new web roll 36 to the web splicing unit 50.

Figure 10:
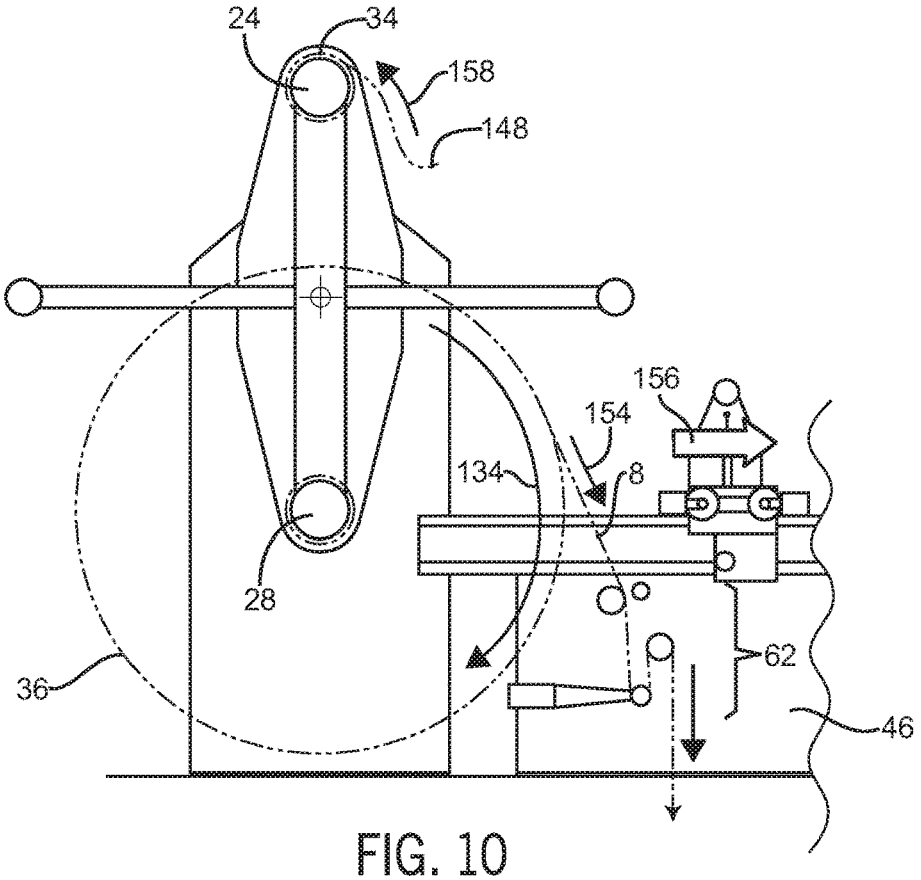
FIG. 10 illustrates unwinding webbing from the new web roll.

As indicated at 154 in FIG. 10, webbing 8 begins unwinding from the new web roll 36 in the standby position 28. As the webbing 8 is unwound, the downstream webbing section 150 from the running web roll 34 is adhered to the new web roll 36. The web splicing unit 50 retracts from the web unwinding unit 4, 40 on which the aforementioned splicing occurred, indicated at 156. The upstream webbing section 148 retracts toward the running web roll 34, as indicated at 158. The webbing 8 continues from the new web roll 36 to the series of guide rolls 62.

Figure 11:
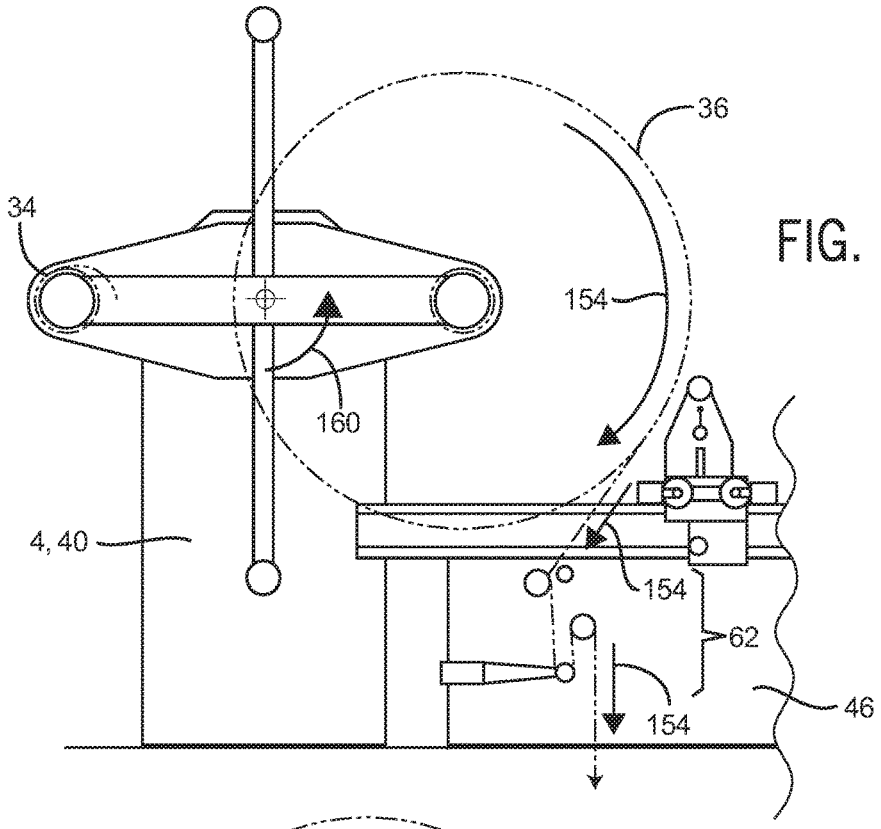
FIG. 11 illustrating the new web roll moving from a standby position to an unwind position.

As indicated in FIG. 11, unwinding 154 of webbing 8 from the new web roll 36 continues while new web roll 36 rotates about axis 14 of the web winding unit mount 12 to move the new web roll 36 from the standby position 28 to the unwind position 24, as indicated at 160. In turn, the running web roll 34 rotates 160 from the unwind position 24 toward the standby position 28. As can be seen in FIG. 11, the web splicing unit 50 is not in contact with the webbing 8 at this moment in the process.

Figure 12:
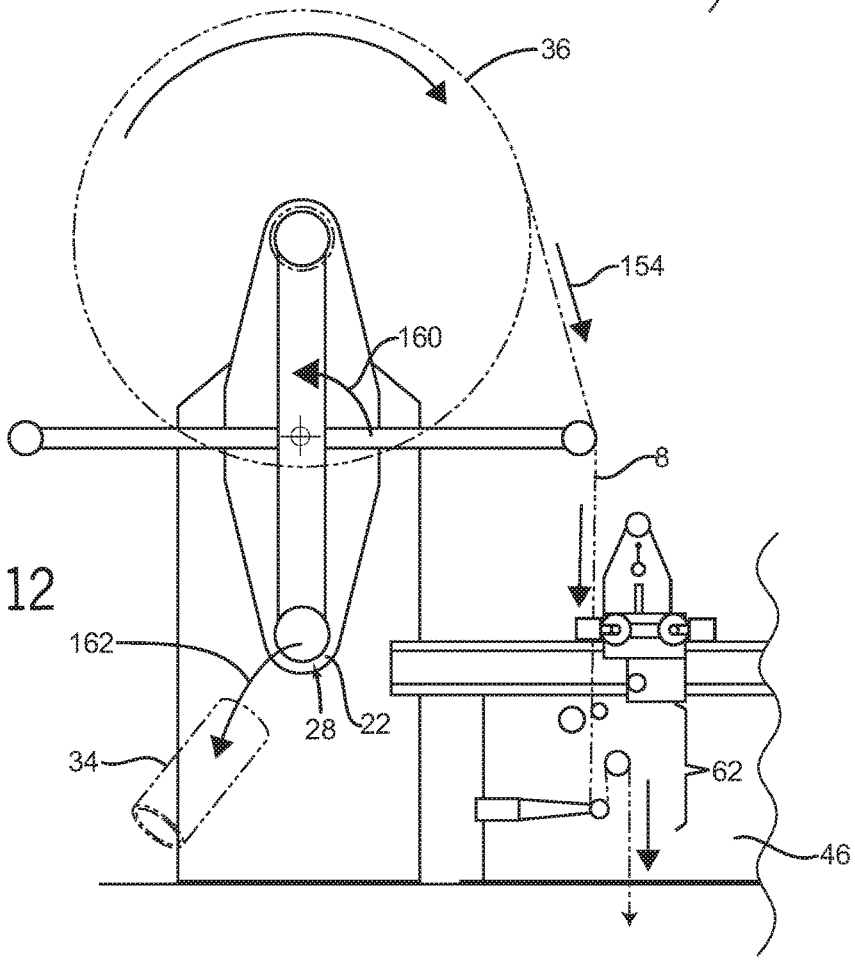
FIG. 12 illustrates webbing from the new web roll unwinding after the new web roll transitions to the unwind position.
Figure 13:
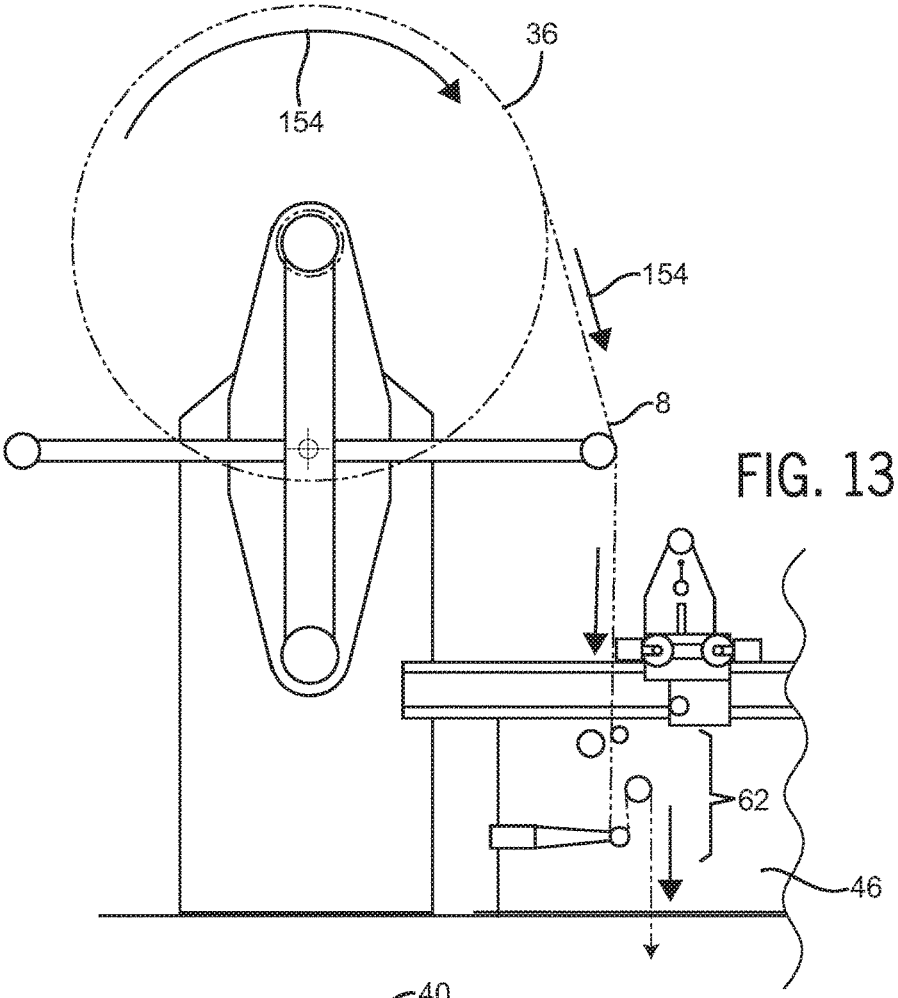
FIG. 13 illustrates webbing from the new web roll continuing to unwind while in the unwind position.

FIG. 12 illustrates completion of the rotation 160 of the web winding unit mount 12, such that the new web roll 36 resides in the unwind position 24 and the running web roll now resides in the standby position 28. While removal 154 of the webbing 8 from the new web roll 36 continues, the running web roll 34 is ejected from the first spindle 22 that is now located at the standby position 28, as indicated at 162. As can be seen in FIG. 13, removal 154 of the webbing 8 from the new web roll 36 continues with the new web roll 36 located in the unwind position 24, with the webbing 8 continuing from the new web roll 36 to the series of guide rolls 62.

Referring now to FIG. 14, a first web unwinding unit 40 and a second web unwinding unit 42 are illustrated in close communication with the web splicing unit 50—with the web splicing unit 50 translating from a position adjacent the first web unwinding unit 40 toward the second web unwinding unit 42, as indicated at 163. In the first web unwinding unit 40, removal 154 of webbing 8 from the new (and now running) web roll 36 continues, while a subsequent replacement web roll 164 replaces the removed running web roll 34 in the standby position. In the second unwinding unit 42, a running web roll 120 is unwound simultaneously with the unwinding of the new web roll 36. The running web roll is located in the unwind position 24 of the second unwinding unit 28, while a new web roll 122 is rotating in the standby position 28 of the second unwinding unit 28, as indicated at 166. The web splicing unit 50 advances towards the second web unwinding unit 42, as indicated at 128.

The aspect of the invention described in FIG. 14 regarding use of the web splicing unit 50 with first and second web unwinding units 40, 42 is possible where the web splicing unit 50 includes a bump roller 94A, 94B in close proximity to each of the splicing unit first side 110 and the splicing unit second side 112. The bump roller 94A interacts with first web unwinding unit 40 to splice webbing 8 between running and new web rolls 34, 36, while the bump roller 94B interacts with second web unwinding unit 42 to splice webbing 8 between running and new web rolls 120, 122. The method of operation described above may repeat indefinitely where additional web rolls replace expired or previously spliced web rolls.

Figure 15:
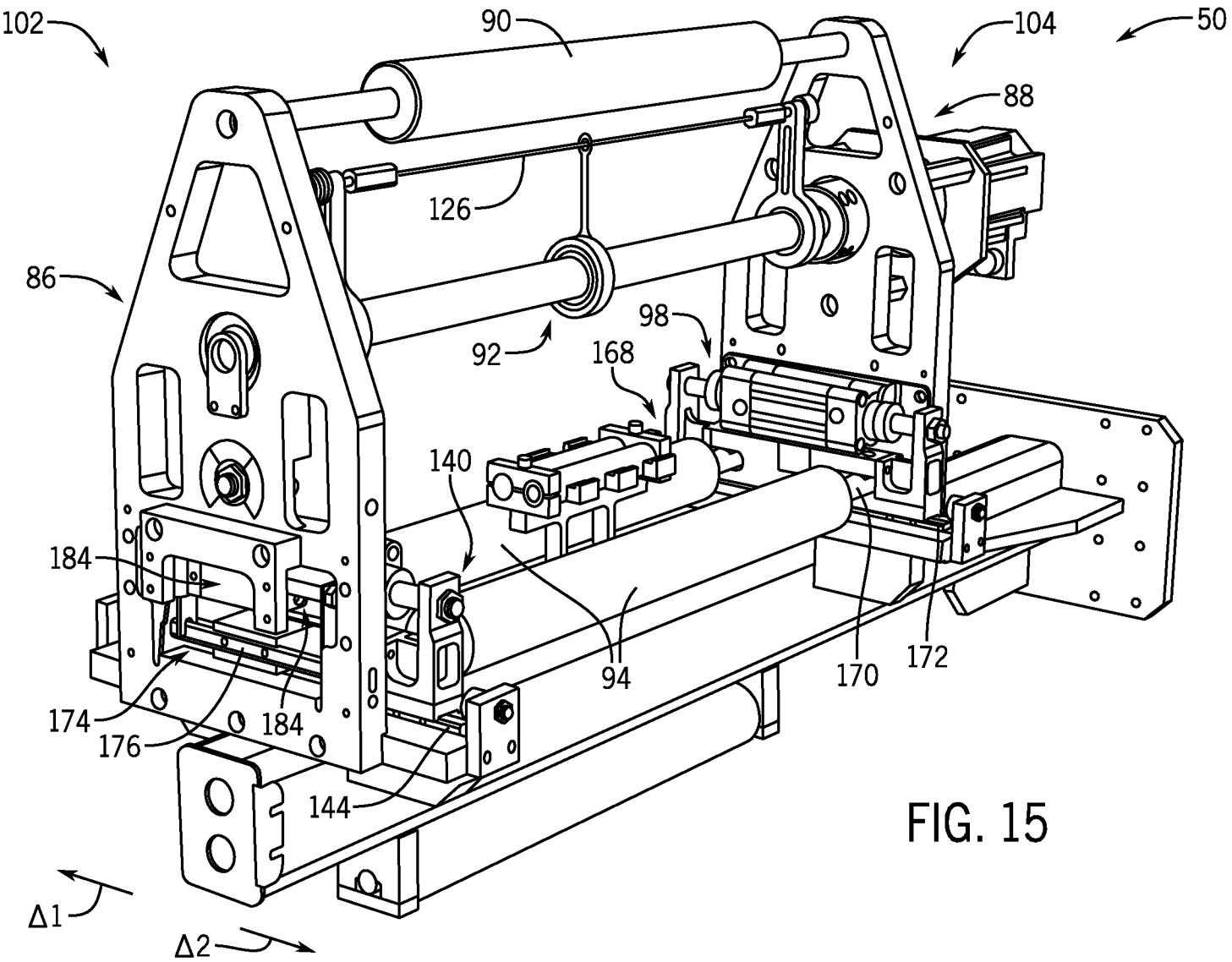
FIG. 15 is a perspective view of a web splicing unit useable in the web splicing apparatus of FIG. 1, according to an exemplary embodiment of the invention.
Figure 16:
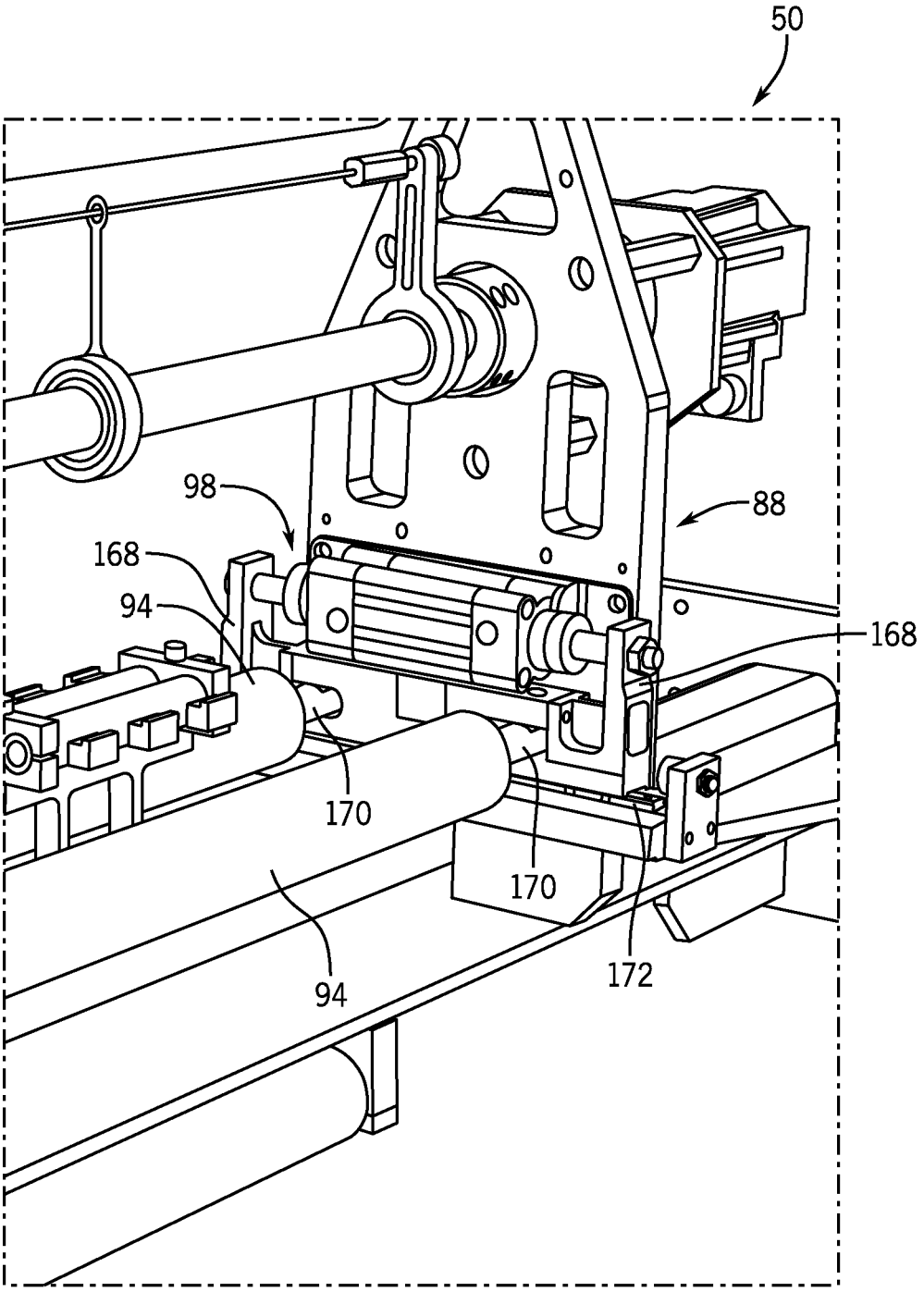
FIG. 16 is a close-up perspective view of a portion of the web splicing unit of FIG. 15 illustrating a bump roller carriage and associated first actuator thereof.
Figure 17:
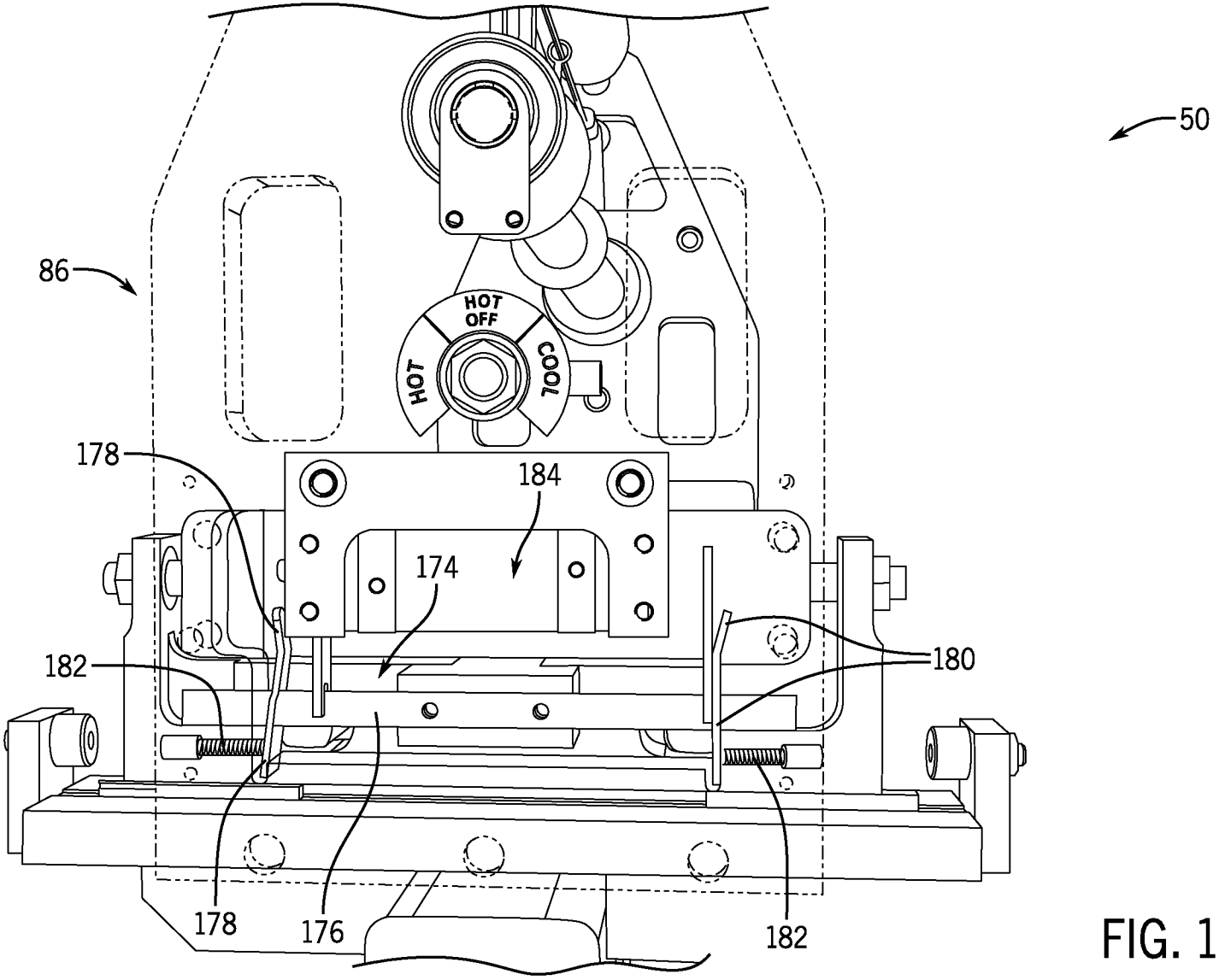
FIG. 17 is a close-up perspective view of a portion of the web splicing unit of FIG. 15 illustrating a locking mechanism and associated second actuator thereof.

Referring now to FIGS. 15-17, the web splicing unit 50 described above is shown in greater detail according to an exemplary embodiment of the invention. As previously described, web splicing unit 50 includes first guide roller 90, cutting assembly 92, bump rollers 94, and bump roller actuators 98—with the splicing unit 50 having first splicing unit section or frame 86 on first end 102 and second splicing unit section or frame 88 on second end 104.

As illustrated in FIGS. 15-17, web splicing unit 50 further includes a bump roller carriage apparatus 168 that, according to an exemplary embodiment, comprises a bump roller carriage on each of first and second ends 102, 104 in which bump rollers 94 are carried (hereinafter referred to as bump roller carriages 168). A support shaft 170 of each bump roller 94 is coupled to bump roller carriages 168 on the first and second ends 102, 104 so as to be secured thereto. Each bump roller carriage 168 is configured to linearly translate along a track or rail 172 provided as part of the respective first or second frame 86, 88, so as to provide for movement of the bump rollers 94. The bump roller actuator 98 provided on each of the first end 102 and second end 104 of web splicing unit 50 operates to selectively translate the bump roller carriage 168 along track 172, such that the bump rollers 94 carried thereby also translate along therewith. According to embodiments of the invention, the bump roller actuators 98 may be actuators of any suitable type, including but not limited to an electric motor or a pneumatic cylinder, for example.

With reference still to FIGS. 15-17 and now also to FIGS. 7, 9, and 14, translation of the bump roller carriages 168 as part of operation of web splicing unit 50 is described in more detail. Splicing of webbing 8 from a first or running web roll 34 with a second or new web roll 36 (at first web unwinding unit 40) is discussed with reference to FIGS. 7 and 9. Splicing of webbing 8 from a fourth or running web roll 120 with a fifth or new web roll 122 (at second web unwinding unit 42) is discussed with reference to FIG. 14. The direction of travel and amount of travel of the bump roller carriages 168 in directions D1, D2 may be selectively controlled via operation of bump roller actuators 98, so as to enable a desired positioning of bump rollers 94 relative to a web material roll to which a web is to be spliced, such as new web roll 36, 122 (FIGS. 7 and 14). That is, bump roller actuators 98 may be operated to cause movement of bump roller carriages 168 in a direction D1 or D2 along track 172, thereby causing bump roller 94 nearest a new web roll 36, 122 to be brought into contact with the running web roll. As a bump roller 94 is brought into contact with a new web roll 36, 122 to be spliced with the running web roll 34, 120 (FIGS. 7 and 14), webbing 8 on the running web roll 34, 120 is cut by cutting wire 126 of cutting assembly 92. The webbing 8 is then passed from first guide roller 90 to bump roller 94, and comes into contact with the adhesive area 136 of the webbing 8 on the new web roll 36, 122 (FIG. 9).

With regard to movement of web splicing unit 50 and bump rollers 94 on bump roller carriages 168 to perform splicing of the webbing 8 on running web roll 34, 120 with the webbing on new web roll 36, 122, as explained above and as best illustrated in FIGS. 7 and 14, it is recognized that bringing a bump roller 94 into contact with the webbing 8 on new web roll 36, 122 may cause a recoil of the bump roller 94 away from the new web roll 36, 122. That is, as bump roller actuators 98 operate to translate the bump roller carriages 168 along tracks 172 and bring a bump roller 94 into contact with web roll 36, 122, it is recognized that the driving of bump roller 94 into new web roll 36, 122 may cause the new web roll 36, 122 to contract/depress inwardly if the webbing is a compliant material. When the bump roller actuators 98 stop providing force to drive the bump roller carriages 168, the new web roll 36, 122 may expand outwardly, thereby generating a force that causes a kickback or recoil of the bump roller carriages 168 (and bump roller 94) in a direction opposite from that in which the bump roller 94 was being driven/translated. Alternatively, the driving of bump roller 94 into new web roll 36, 122 may cause the bump roller 94 to contract/depress inwardly when the new web roll 36, 122 is a firm web material (e.g., poly-based webbing) and the bump roller 94 is formed of a compliant material. In either embodiment, the bump roller 94 may thus not be properly positioned to enable splicing of the webbing 8 from the running web roll 34, 120 to new web roll 36, 122, as bump roller 94 may not be positioned close enough to new web roll 36, 122 to cause the webbing 8 from running web roll 34, 120 to come into contact with new web roll 36, 122 to affix the webbing section 150 to the adhesive area 136 of the webbing 8 on the new web roll 36, 122.

In order to address the potential for a kickback or recoil of bump roller 94 away from new web roll 36, 122, a locking mechanism 174 is provided as part of each of the first and second frames 86, 88 that may be locked and unlocked to selectively enable movement of the respective bump roller carriages 168 along track 172, as further illustrated in FIGS. 15-17. According to one embodiment, each locking mechanism 174 comprises a locking bar 176, locking pawls (or levers) on opposing ends of the locking bar 176 (i.e., first locking pawl 178 and second locking pawl 180), and springs 182 associated with the locking pawls 178, 180 to position the locking pawls in a lock-ready position. A locking actuator 184 positioned on each of the first and second frames 86, 88 control operations of the respective locking mechanisms 146 by causing movement of the locking pawls 178, 180 from an angled, lock-ready position to a vertical unlocked position. According to one embodiment, locking actuators 184 are provided as pneumatic cylinders, but may alternatively be provided as electric motors or other suitable actuating devices. Additionally, it is recognized that rather than comprising locking bar 176 and locking pawls 178, 180, locking mechanism 174 may instead comprise alterative suitable clamping/locking devices, such as a rack with locking pawls on each end, a single turret system, gear teeth, an angled locking component, or the like.

Dependent on the direction of travel desired by bump roller carriages 168 and bump rollers 94, and as illustrated in the example provided in FIG. 17, locking actuator 184 associated with each locking mechanism 174 is controlled to force second locking pawl 180 into a vertical position, thereby allowing for the locking bar 176 to pass thru it freely in either direction. On the opposite side of locking bar 176, spring 182 pushes on first locking pawl 178 to maintain it in a "lock ready" state. With locking pawls 178, 180 in these positions—first locking pawl 178 lock-ready and second locking pawl 180 vertical—the locking bar 176 and bump roller carriage 168 are allowed to travel freely in a first desired direction but bind and lock up in the opposite direction when subject to any recoil caused by the bump roller 94 hitting the new web roll 36, 122. After the splice is completed, the locking actuator 184 of each locking mechanism 174 operates/actuates in the opposite direction, so as to the allow the locking bar 176 and bump roller carriage 168 to travel freely back in the opposite direction, so as to provide for movement of the bump roller carriage 168 away from the new web roll 36, 122 and prepare the web splicing unit 50 for a subsequent splicing operation of another new web roll 36, 122 at another web unwinding unit 40, 28, such as illustrated in FIG. 14.

According to one embodiment, the bump roller carriages 168 on first and second ends 102, 104 of the web splicing unit 50 are free to travel and lock independently from one another (via independent operation of bump roller actuators 98 and locking actuators 184 on each of the ends 102, 104) to accommodate a web roll that may be higher on one end than the other. That is, it is recognized that in bringing the web splicing unit 50 (and bump rollers 94 thereof) into contact with a new web roll 36, 122, the face of the web roll may not necessarily be flush/square/planar with the bump roller 94 based on a curvature of the web roll, etc. The independent locking of bump roller carriages 168 may enable the web splicing unit 50 to account for such variability in the web roll and provide for consistent contact between the bump roller 94 and the web roll. As previously described, each of first and second ends 102, 104 has its own bump roll actuator 98 and locking actuator 184 for moving bump roller carriage 168 and for selectively activating locking mechanism 174.

Referring now to FIGS. 18-21, and with continued reference to FIGS. 15-17, a sequence of operational steps is provided that illustrates a process flow according to which web splicing unit 50 is operated. The web splicing unit 50 is moved and controlled to provide splicing between web rolls (web rolls 24, 25 or web rolls 120, 122, as shown in FIGS. 7 and 14) on each of a first web unwinding unit 40 and a second web unwinding unit 42, according to a technique as generally previously described but now explained in further detail here below.

Figure 18A:
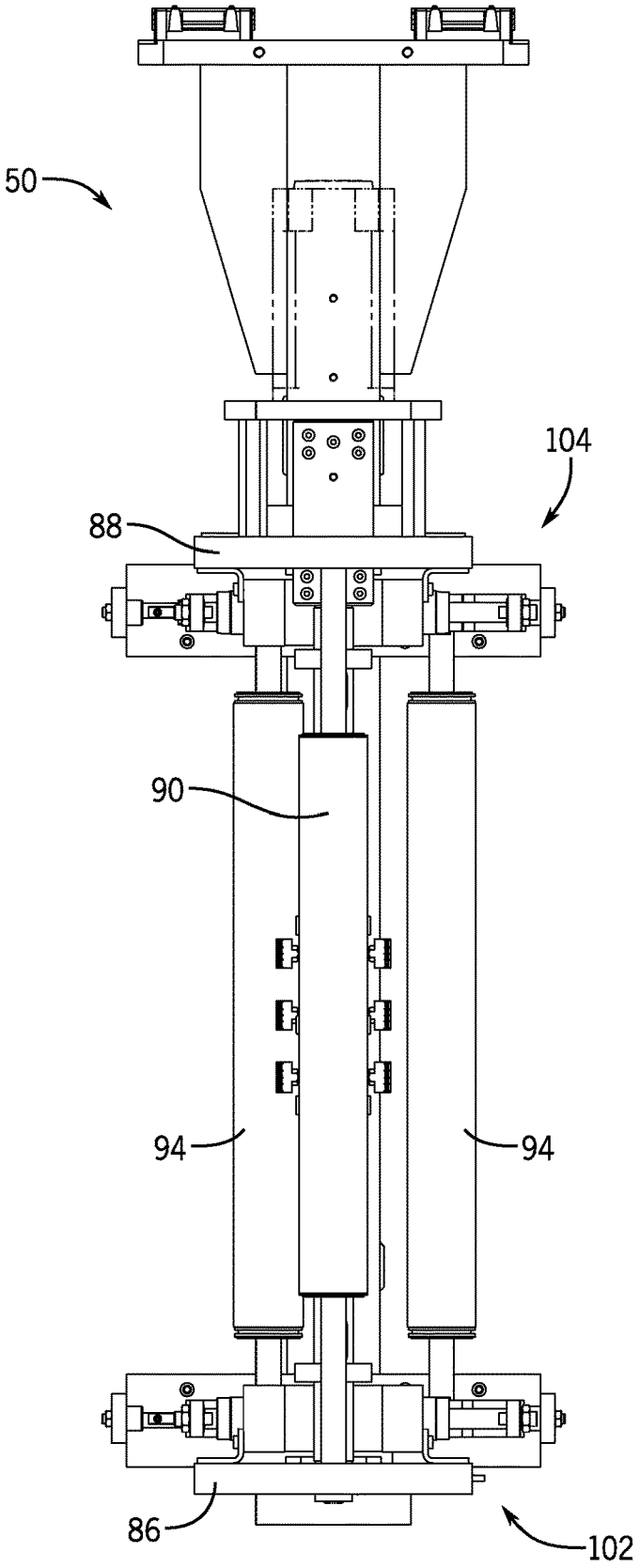
FIGS. 18A and 18B are top and front views, respectively, of the web splicing unit of FIG. 15 in a ready bump left position/state.
Figure 18B:
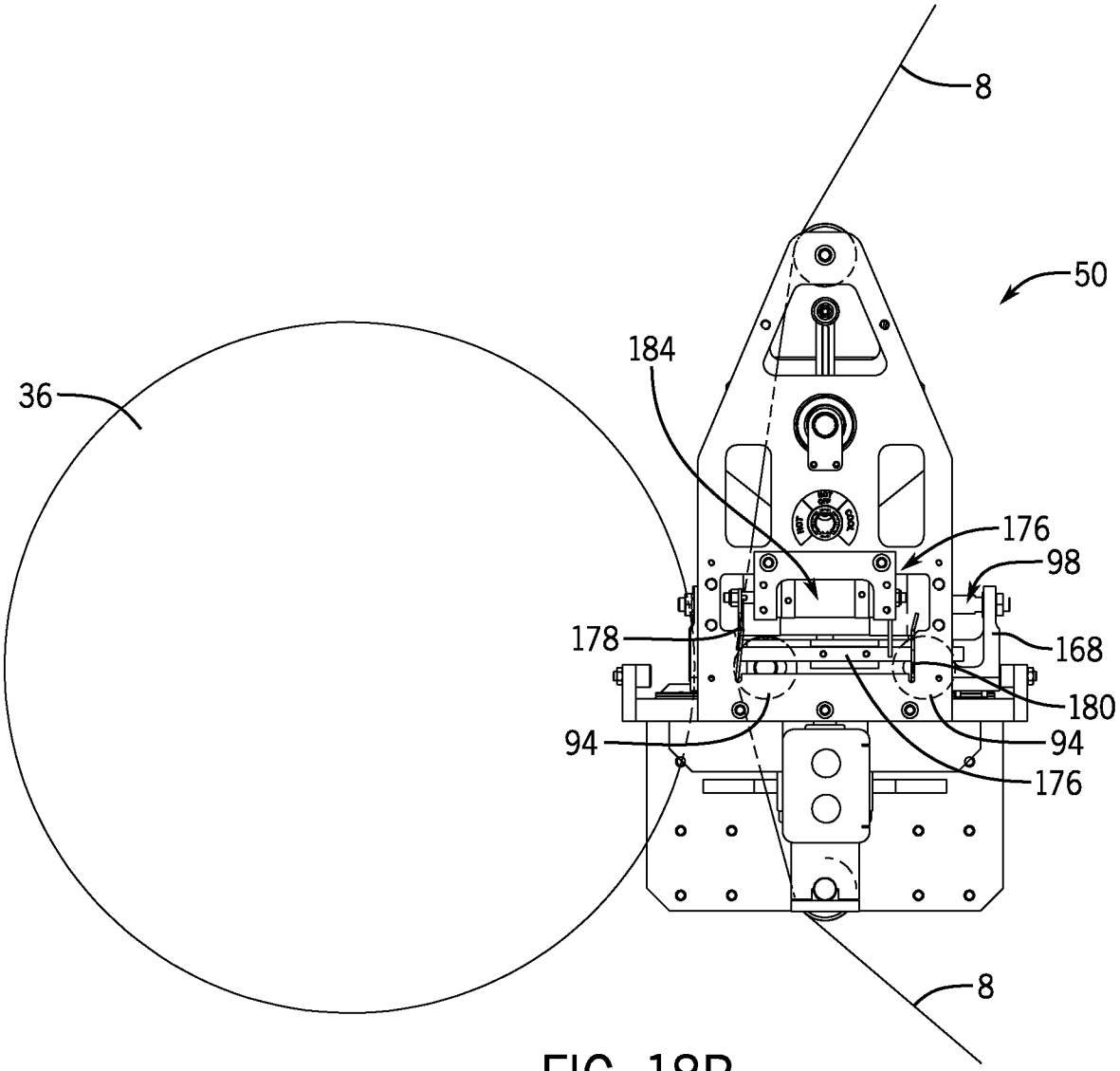

Referring first to FIGS. 18A and 18B, web splicing unit 50 is first illustrated in a "ready bump left" position/state, where web splicing unit 50 is positioned proximate a new web roll 36 (on a first web unwinding unit 40) to which webbing 8 from an expiring web roll (not shown) is to be spliced. In the ready bump left position/state, the locking mechanism 174 in each of the first and second frames 86, 88 is actuated to a state that provides translation/movement of the bump roller carriages 168 to the left and toward new web roll 36, but prevents movement of the bump roller carriages 168 back in the opposite direction, so as to prevent a kickback or recoil of the bump roller carriages 168 as previously described. To bring the web splicing unit 50 into the ready bump left position/state, the locking actuator 184 on each of first and second ends 102, 104 is operated to cause the first locking pawl 178 of the respective locking mechanism 174 to be moved to an angled, lock-ready position, while the second locking pawl 180 of each locking mechanism 174 is maintained in its vertical position. With the locking pawls 178, 180 in these positions, the respective locking bars 148 and bump roller carriages 168 are allowed to travel freely to the left but are restricted from moving to the right, with the locking bar 176 and bump roller 94 bound and locked up from moving to the right.

Figure 19A:
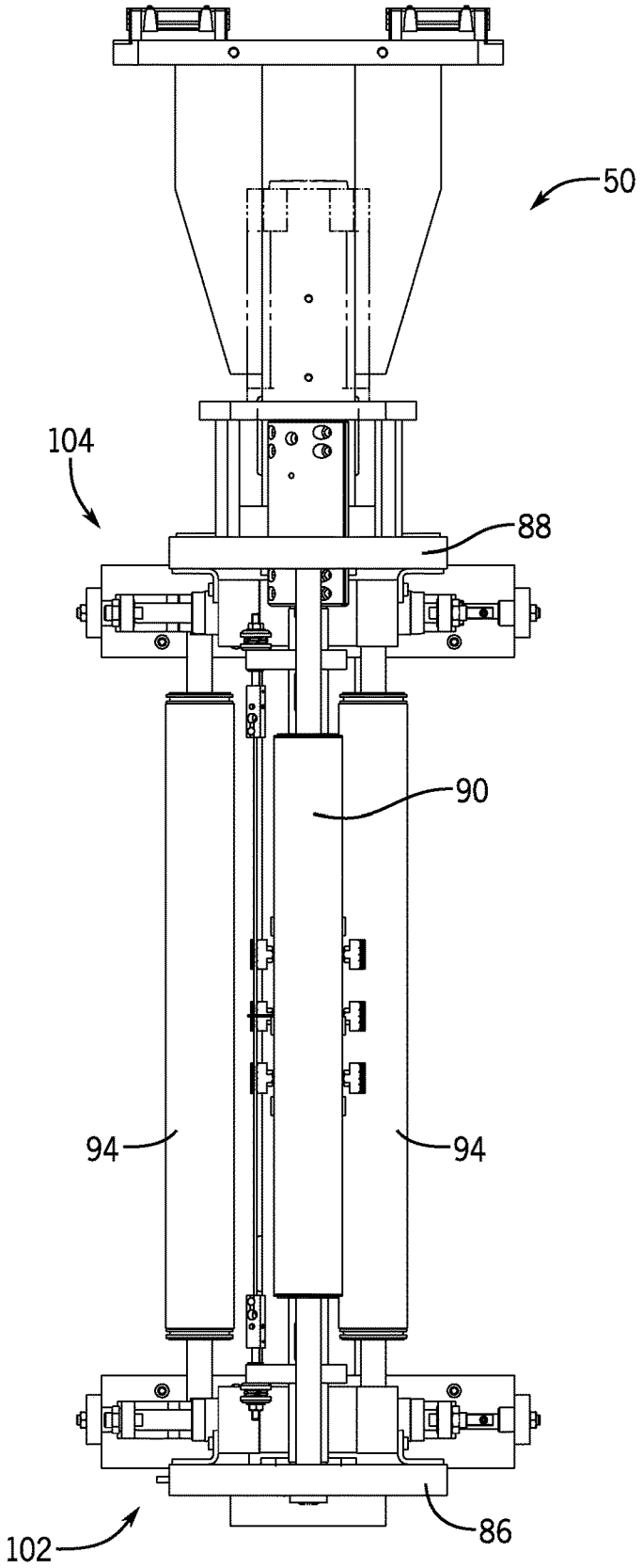
FIGS. 19A and 19B are top and front views, respectively, of the web splicing unit of FIG. 15 in a bump left locked position/state.
Figure 19B:
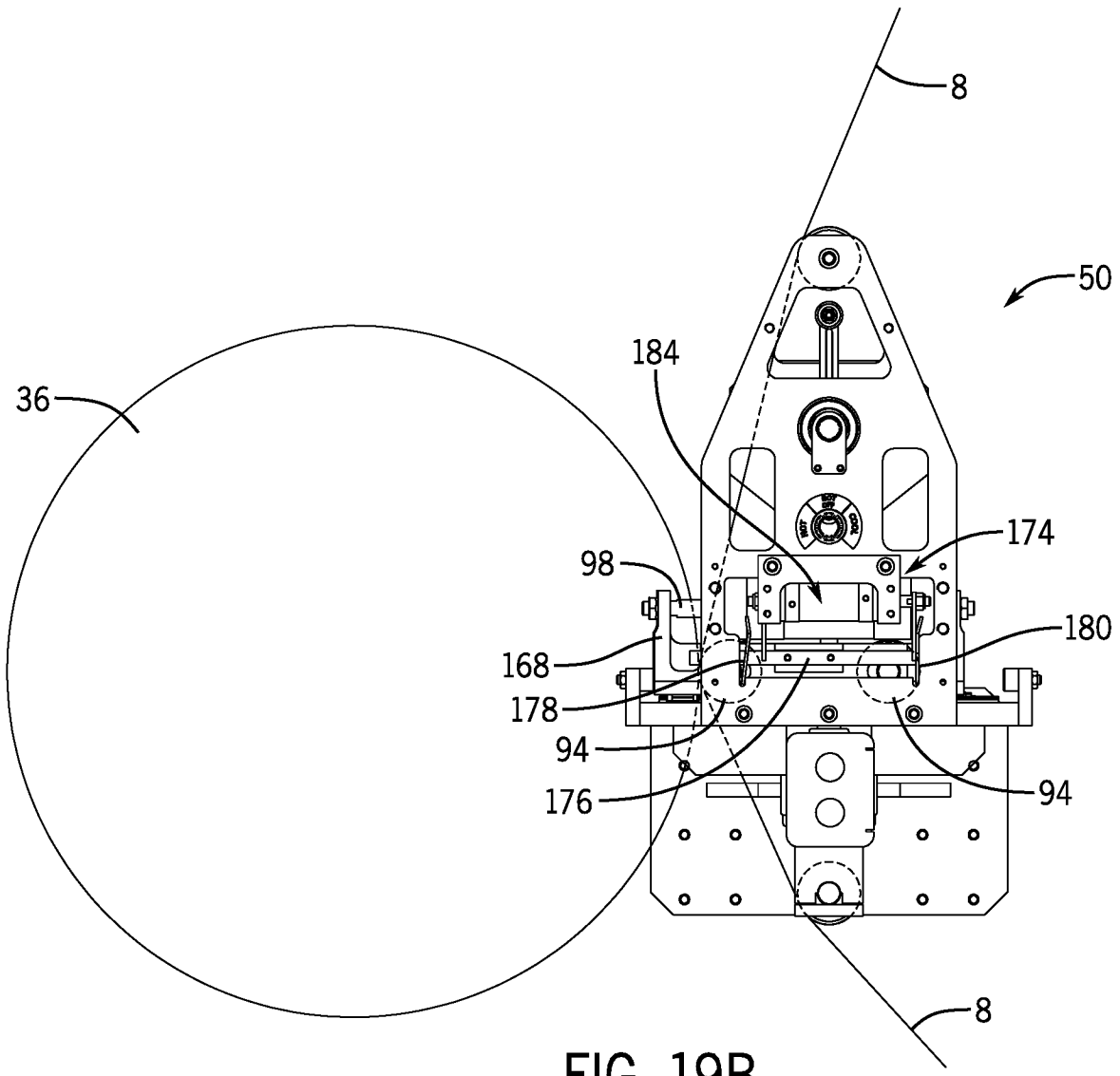

Upon bringing the web splicing unit 50 into the ready bump left position/state, the web splicing unit 50 is then transferred into the "bump left locked" position/state, as illustrated in FIGS. 19A and 19B. In the bump left locked position/state, the bump roller actuator 98 on each of first and second ends 102, 104 has been operated to translate the bump roller carriages 168 (and bump rollers 94) toward new web roll 36, such that the left bump roller 94 has been brought into contact with new web roll 36. In the bump left locked position/state, the first locking pawl 178 of each locking mechanism 174 is retained in the angled, lock-ready position while the second locking pawl 180 of each locking mechanism 174 is retained in its vertical position, such that locking bar 176 and bump roller carriage 168 are allowed to travel freely to the left but prevented from moving to the right. Accordingly, left bump roller 94 is "locked" in place against new web roll 36 to provide for effective splicing of webbing 8 from an expiring web roll (not shown) with webbing on new web roll 36, without the bump roller 94 being subject to or affected by any recoil caused by the bump roller 94 hitting the new web roll 36.

Upon completion of a splicing operation between webbing 8 from the expiring web roll with webbing on new web roll 36, the locking actuator 184 on each of first and second ends 102, 104 is operated to cause the second locking pawl 180 of the respective locking mechanism 174 to be moved to the angled, lock-ready position and the first locking pawl 178 of the respective locking mechanism 174 to be moved to the vertical position, so as to allow the locking bar 176 and bump roller carriage 168 to travel freely to the right. The bump roller carriages 168 of web splicing unit 50 may thus be moved away from the web roll via operation of bump roller actuators 98, with the web splicing unit 50 then being ready to perform a next splicing operation, either on a first web unwinding unit 40 or a on a second web unwinding unit 42.

Figure 20A:
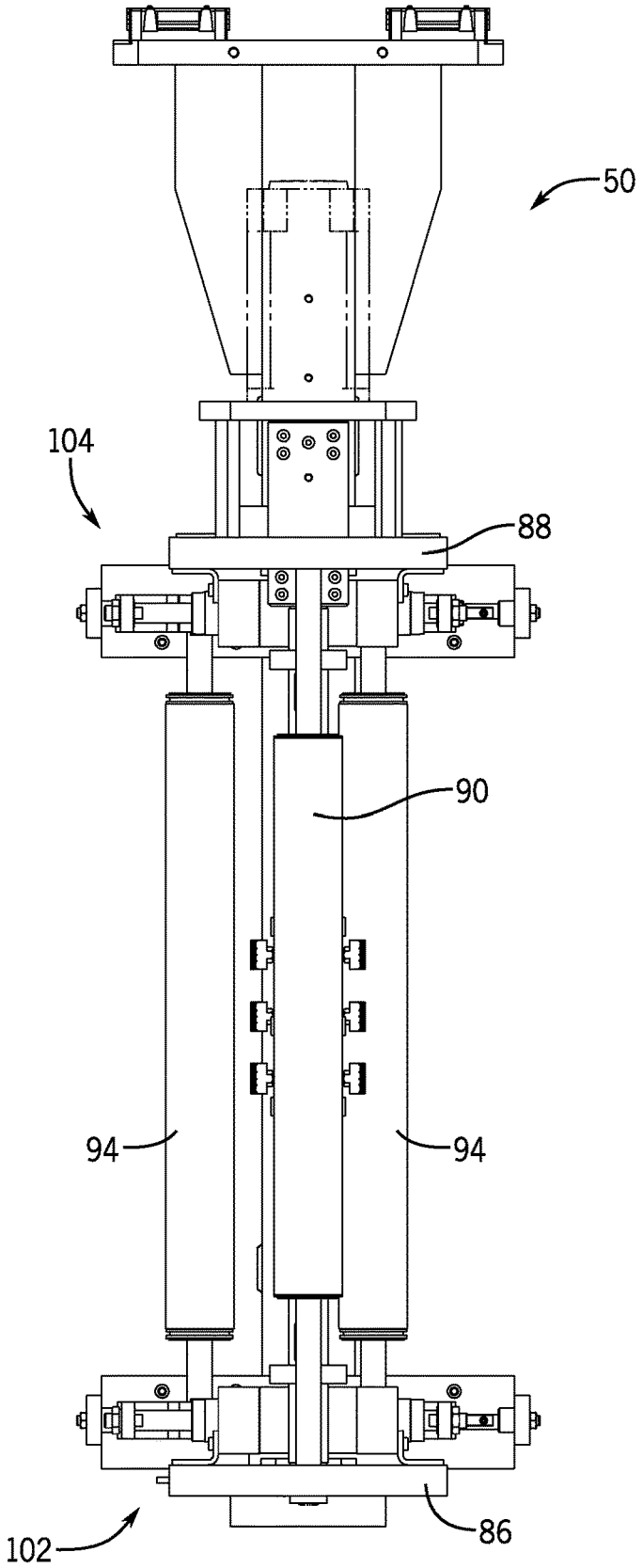
FIGS. 20A and 20B are top and front views, respectively, of the web splicing unit of FIG. 15 in a ready bump right position/state.
Figure 20B:
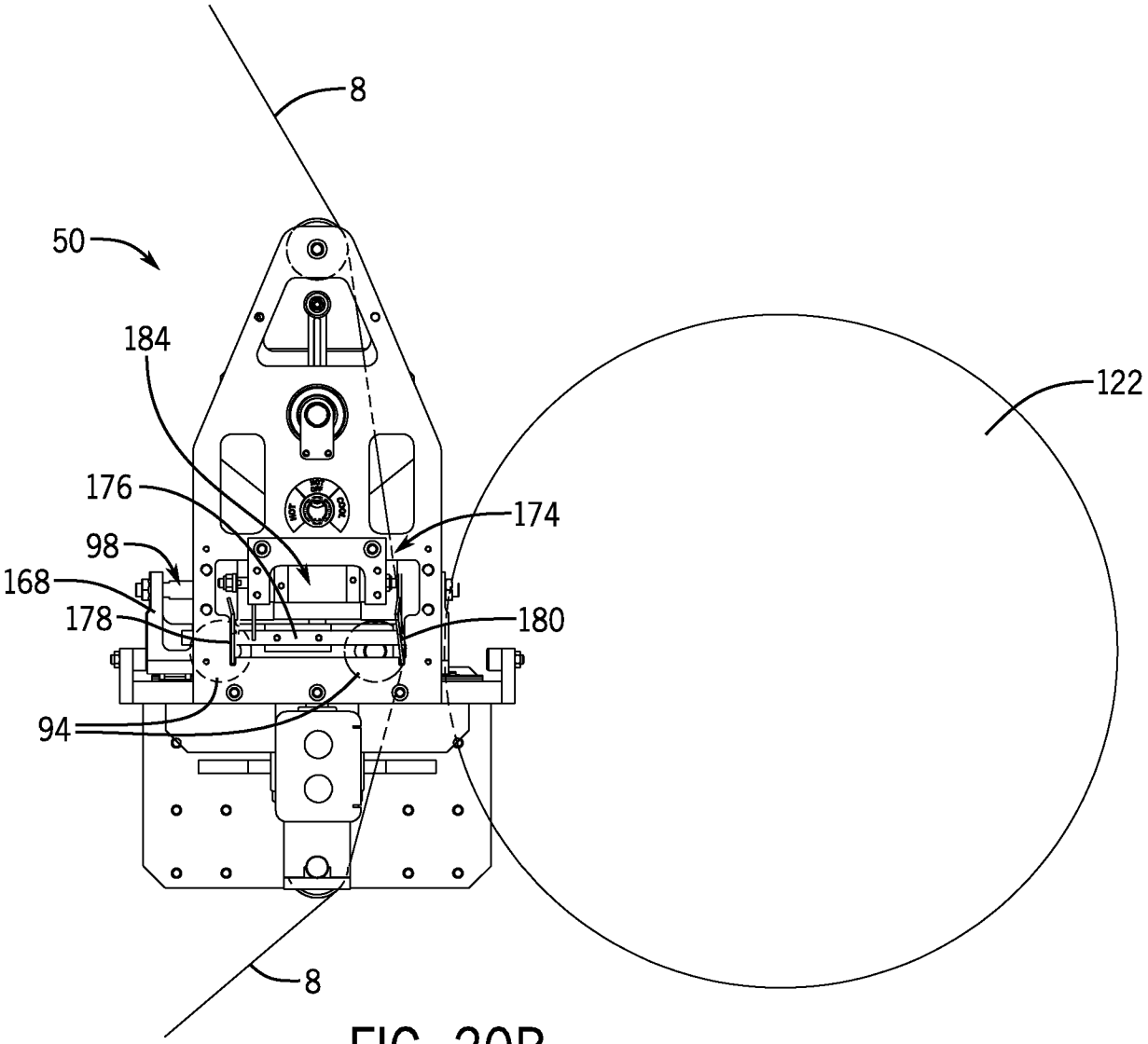

Referring now to FIGS. 20A and 20B, web splicing unit 50 is now illustrated in a "ready bump right" position/state, where web splicing unit 50 is positioned proximate a new web roll 122 (on a second web unwinding unit 42) to which webbing 8 from an expiring web roll (not shown) is to be spliced. As described previously, web splicing unit 50 would be translated along rail assembly 48 (e.g., driven by splice unit drive 85, FIG. 1) to bring it toward new web roll 122 and into the illustrated position. In the ready bump right position/state, the locking mechanism 174 in each of the first and second frames 86, 88 is actuated to a state that provides translation/movement of the bump roller carriages 168 to the right and toward new web roll 122, but prevents movement of the bump roller carriages 168 back in the opposite direction, so as to prevent a kickback or recoil of the bump roller carriages 168 as previously described. To bring the web splicing unit 50 into the ready bump right position/state, the locking actuator 184 on each of first and second ends 102, 104 is operated to cause the second locking pawl 180 of the respective locking mechanism 174 to be moved to its angled, lock-ready position, while the first locking pawl 178 of each locking mechanism 174 is positioned in its vertical position. With the locking pawls 178, 180 in these positions, the respective locking bars 148 and bump roller carriages 168 are allowed to travel freely to the right but are restricted from moving to the left, with the locking bar 176 and bump roller 94 bound and locked up from moving to the left.

Figure 21A:
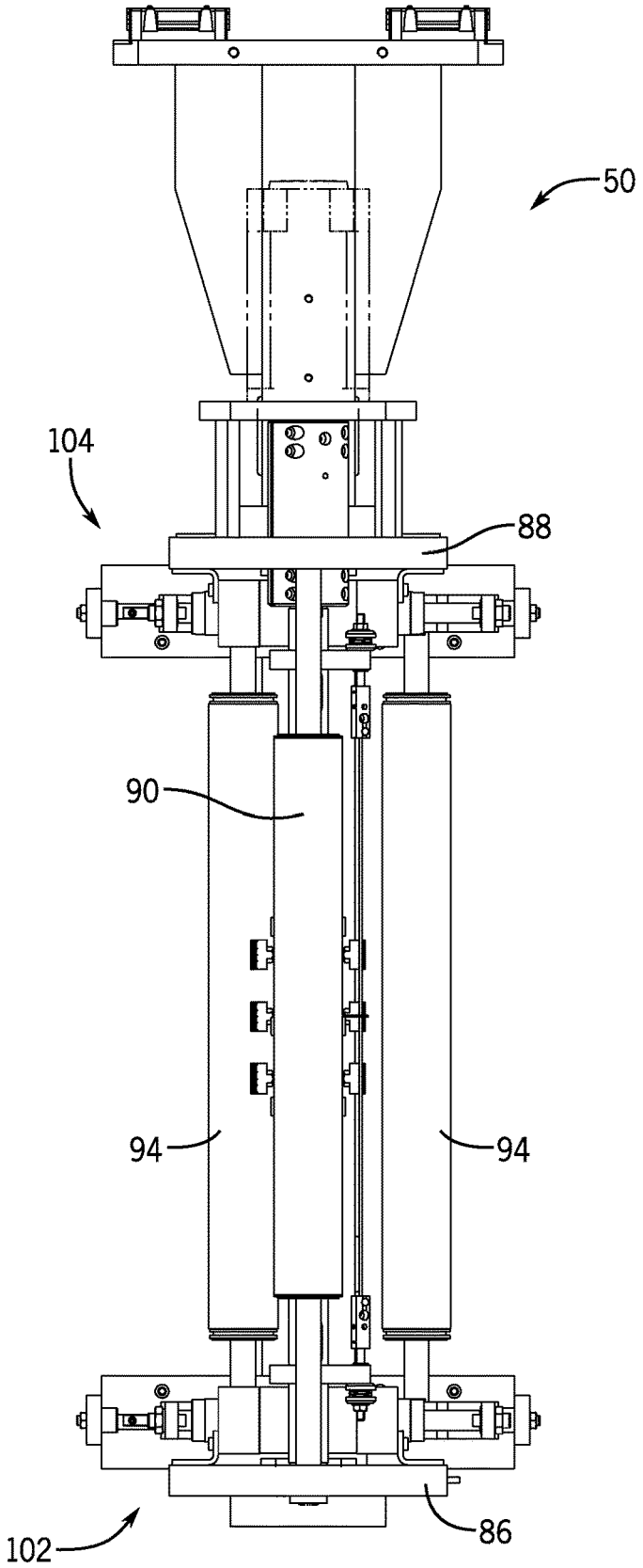
FIGS. 21A and 21B are top and front views, respectively, of the web splicing unit of FIG. 15 in a bump right locked position/state.
Figure 21B:
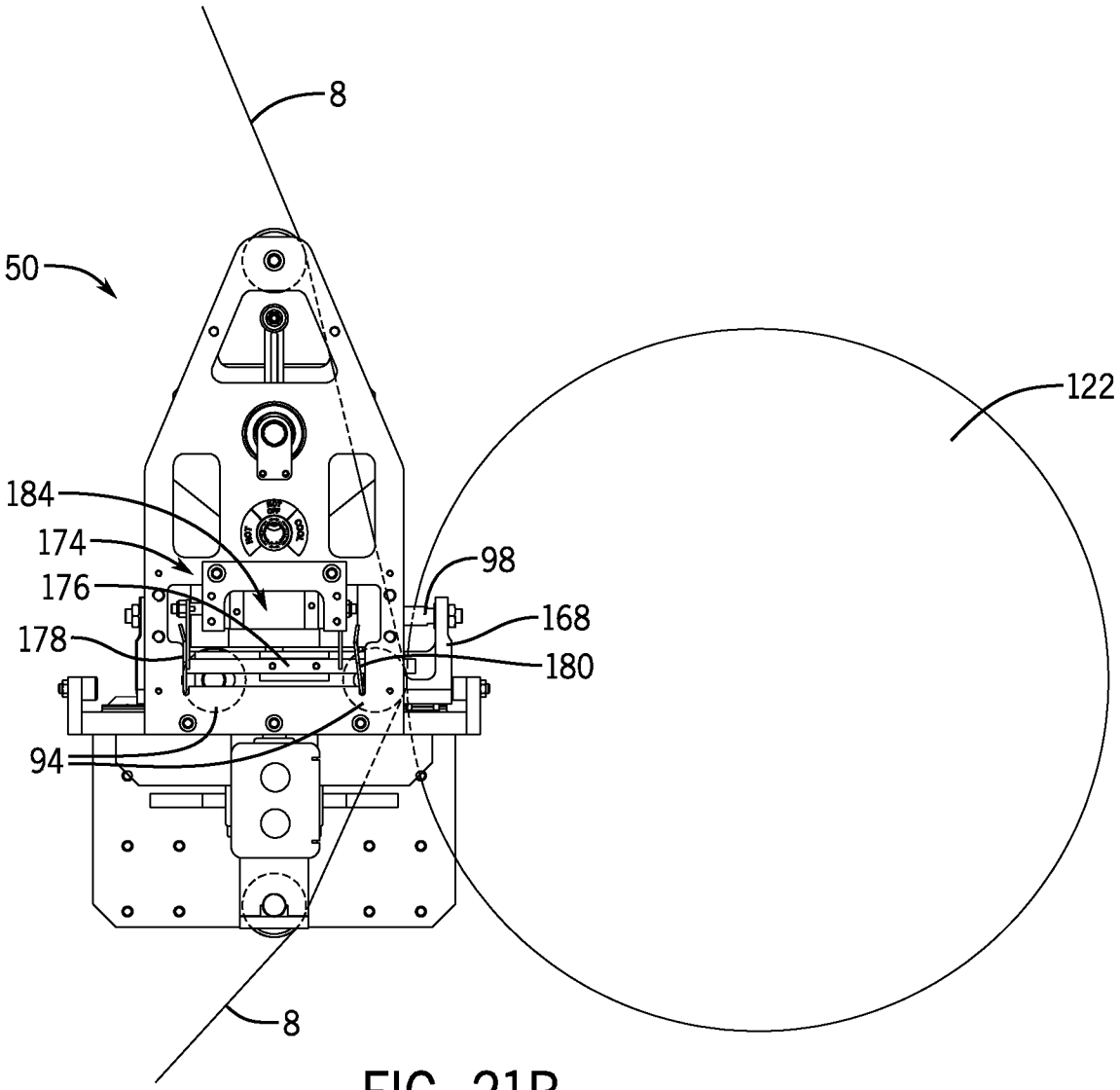

Upon bringing the web splicing unit 50 into the ready bump right position/state, the web splicing unit 50 is then transferred into the "bump right locked" position/state, as illustrated in FIGS. 21A and 21B. In the bump right locked position/state, the bump roller actuator 98 on each of first and second ends 102, 104 has been operated to translate the bump roller carriages 168 (and bump rollers 94) toward new web roll 122, such that the right bump roller 94 has been brought into contact with new web roll 122. In the bump right locked position/state, the second locking pawl 180 of the each locking mechanism 174 is in the angled, lock-ready position while the first locking pawl 178 of each locking mechanism 174 is retained in its vertical position, such that locking bar 176 and bump roller carriage 168 are allowed to travel freely to the right but prevented from moving to the left. Accordingly, right bump roller 94 is "locked" in place against new web roll 122 to provide for effective splicing of webbing 8 from an expiring web roll (not shown) with webbing on new web roll 122, without the bump roller 94 being subject to or affected by any recoil caused by the bump roller 94 hitting the new web roll 122.

Upon completion of a splicing operation between webbing 8 from the expiring web roll with webbing on new web roll 122, the locking actuator 184 on each of first and second ends 102, 104 is operated to cause the second locking pawl 180 of the respective locking mechanism 174 to be moved to the vertical position and the first locking pawl 178 of the respective locking mechanism 174 to be moved to the angled, lock-ready position, so as to allow the locking bar 176 and bump roller carriage 168 to travel freely to the left. The bump roller carriages 168 of web splicing unit 50 may thus be moved away from the new web roll 122 via operation of bump roller actuators 98, with the web splicing unit 50 then being ready to perform a next splicing operation, either on first web unwinding unit 40 or on second web unwinding unit 42.

Beneficially, embodiments of the invention thus provide a web splicing unit and method of operation thereof that translates one or more bump rollers thereof relative to a webbing of the material rolls, so as to selectively cause the splicing of webbing from a first material roll with the webbing from a second material roll. Operation of the web splicing unit provides for such splicing while preventing a kickback or recoil of the bump roller relative to the material rolls, so as to provide a consistent and reliable splicing of the webbing. Additionally, operation of the web splicing unit provides for the splicing of web rolls in multiple web roll lines.

Therefore, according to one embodiment of the invention, a web splicing apparatus includes a web unwinding unit configured to hold a running web material roll and a new web material roll and to unwind webbing from the running web material roll. The web splicing apparatus also includes a web splicing unit operable with the web unwinding unit to selectively splice the webbing of the running web material roll with webbing of the new web material roll, with the web splicing unit further comprising a cutting assembly configured to selectively sever the webbing of the running web material roll, a web deflection device, an actuator system configured to linearly translate the web deflection device in a first direction and a second direction opposite the first direction, and a locking mechanism operable in a locked state and an unlocked state to selectively prohibit and enable movement of the web deflection device in the first direction and the second direction.

According to another embodiment of the invention, a method for splicing webbing of a running web material roll with webbing of a new web material roll is provided. The method includes positioning a web splicing unit in proximity to the running web material roll and the new web material roll, severing webbing of the running web material roll with a cutting assembly of the web splicing unit, and bringing a web deflection device of the web splicing unit into contact with the new web material roll to cause a section of the webbing of the running web material roll to splice with webbing of the new web material roll. In bringing the web deflection device into contact with the new web material roll, the method further comprises operating a locking mechanism of the web splicing unit to allow movement of the web deflection device in a first direction toward the new web material roll and inhibit movement of the web deflection device in a second direction away from the new web material roll and operating an actuator system of the web splicing unit to cause the web deflection device to move in the first direction, so as to bring the web deflection device into contact with the new web material roll, wherein the locking mechanism prevents movement of the web deflection device in a second direction away the new web material roll to prevent a recoil of the web deflection device away from the new web material roll.

According to yet another embodiment of the invention, a web splicing unit operable with a web unwinding unit to enable splicing of webbing of a running web material roll with webbing of a new web material roll is provided. The web splicing unit includes a frame, a cutting assembly configured to sever the webbing of the running web material roll, a carriage apparatus coupled to the frame, the carriage apparatus carrying a web deflection unit, an actuator system configured to linearly translate the web deflection unit along the frame in a first direction and a second direction opposite the first direction, and at least one locking mechanism operable in a locked state and an unlocked state to selectively prohibit and enable movement of the web deflection unit in the first direction and the second direction.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A web splicing apparatus comprising:

a web unwinding unit configured to hold a running web material roll and a new web material roll and to unwind webbing from the running web material roll; and a web splicing unit operable with the web unwinding unit to selectively splice the webbing of the running web material roll with webbing of the new web material roll, the web splicing unit comprising:

a frame;

a cutting assembly configured to selectively sever the webbing of the running web material roll;

a guide roller mounted on the frame to receive the webbing from the running web material roll and guide it toward the cutting assembly;

a web deflection device mounted on the frame so as to be translatable therealong in a first direction and a second direction opposite the first direction;

an actuator system configured to linearly translate the web deflection device in the first direction and the second direction; and a locking mechanism operable in a locked state and an unlocked state to selectively prohibit and enable movement of the web deflection device in the first direction and the second direction.

2. The web splicing apparatus of claim 1 wherein the frame comprises tracks formed thereon upon which the web deflection device translates in the first direction and the second direction.

3. The web splicing apparatus of claim 1 wherein the web deflection device comprises one or more bump rollers.

4. The web splicing apparatus of claim 1 wherein the locking mechanism comprises:

a locking bar; and a first locking pawl and second locking pawl positioned on opposing ends of the locking bar, each of the first and second locking pawls movable between a lock-ready position and an unlocked position.

5. The web splicing apparatus of claim 4 wherein the web splicing unit further comprises a locking actuator positioned adjacent the locking mechanism, the locking actuator configured to control operations of the locking mechanism by selectively actuating the first and second locking pawls between the lock-ready position and the unlocked position.

6. The web splicing apparatus of claim 5 wherein positioning of the first locking pawl in the unlocked position and the second locking pawl in the lock-ready position enables movement of the web deflection device in the first direction and prohibits movement in the second direction; and wherein positioning of the first locking pawl in the lock-ready position and the second locking pawl in the unlocked position prohibits movement of the web deflection device in the first direction and enables movement in the second direction.

7. The web splicing apparatus of claim 4 wherein the locking mechanism further comprises a spring associated with each of the first and second locking pawls to bias the first and second locking pawls in the lock-ready position.

8. The web splicing apparatus of claim 1 wherein the web unwinding unit comprises a first web unwinding unit;

wherein the web splicing apparatus further comprises a second web unwinding unit configured to hold a second running web material roll and a second new web material roll each having a webbing thereon and unwind the webbing from the second running web material roll; and wherein the web splicing unit is positioned between the first web unwinding unit and the second web unwinding unit, with the web splicing unit movable between the first web unwinding unit and the second web unwinding unit via translation thereof along a rail extending between the first web unwinding unit and the second web unwinding unit.

9. The web splicing apparatus of claim 8 wherein the web deflection device comprises a first bump roller and a second bump roller, with the first bump roller enabling web splicing on the first web unwinding unit and the second bump roller enabling web splicing on the second web unwinding unit.

10. A method for splicing webbing of a running web material roll with webbing of a new web material roll, the method comprising:

positioning a web splicing unit in proximity to the running web material roll and the new web material roll;

severing webbing of the running web material roll with a cutting assembly of the web splicing unit; and bringing a web deflection device of the web splicing unit into contact with the new web material roll via linearly sliding a carriage carrying the web deflection device along a frame of the web splicing unit, so as to cause a section of the webbing of the running web material roll to splice with webbing of the new web material roll;

wherein bringing the web deflection device into contact with the new web material roll comprises:

operating a locking mechanism of the web splicing unit to allow movement of the carriage carrying the web deflection device in a first direction toward the new web material roll and inhibit movement of the carriage carrying the web deflection device in a second direction away from the new web material roll; and operating an actuator system of the web splicing unit to cause the carriage carrying the web deflection device to move in the first direction, so as to bring the web deflection device into contact with the new web material roll;

wherein the locking mechanism prevents movement of the carriage carrying the web deflection device in a second direction away from the new web material roll to prevent a recoil of the web deflection device away from the new web material roll.

11. The method of claim 10 wherein sliding the carriage carrying the web deflection device along the frame comprises sliding the carriage carrying the web deflection device along a pair of tracks included on the frame of the web splicing unit, via operation of the actuator system.

12. The method of claim 10 wherein operating the locking mechanism comprises selectively positioning a first locking pawl and a second locking pawl into a lock-ready position or an unlocked position to allow and inhibit movement of the carriage along the pair of tracks, the first and second locking pawls being selectively positioned via operation of locking actuators positioned on the frame and configured to actuate the first and second locking pawls.

13. The method of claim 12 further comprising operating the locking actuators to position the first locking pawl in the unlocked position and the second locking pawl in the lock-ready position to allow movement of the web deflection device in the first direction and prohibit movement of the web deflection device in the second direction.

14. The method of claim 12 further comprising, upon completion of the splicing of the webbing of the running web material roll with the webbing of the new web material roll:

operating the locking actuators to position the second locking pawl of each locking mechanism in the unlocked position to allow movement of the web deflection device in the second direction; and operating the actuator system to cause the web deflection device to move in the second direction and away from the new web material roll.

15. A web splicing unit operable with a web unwinding unit to enable splicing of webbing of a running web material roll with webbing of a new web material roll, the web splicing unit comprising:

a frame;

a cutting assembly configured to sever the webbing of the running web material roll;

a guide roller mounted on the frame to receive the webbing from the running web material roll and guide it toward the cutting assembly;

a carriage apparatus coupled to the frame so as to be translatable therealong, the carriage apparatus carrying a web deflection unit;

an actuator system configured to linearly translate the web deflection unit along the frame in a first direction and a second direction opposite the first direction; and at least one locking mechanism operable in a locked state and an unlocked state to selectively prohibit and enable movement of the web deflection unit in the first direction and the second direction.

16. The web splicing unit of claim 15 wherein the frame comprises a pair of tracks upon which the web deflection unit is translatable in the first direction and the second direction.

17. The web splicing unit of claim 15 wherein the web deflection unit comprises a at least one bump roller.

18. The web splicing unit of claim 17 wherein the carriage apparatus comprises a pair of bump roller carriages free to travel and lock independently from one another.

19. The web splicing unit of claim 15 wherein the locking mechanism comprises:

a locking bar;

a first locking pawl and second locking pawl positioned on opposing ends of the locking bar, each of the first and second locking pawls movable between a lock-ready position and an unlocked position; and a spring associated with each of the first and second locking pawls to bias the first and second locking pawls in the lock-ready position.

20. The web splicing unit of claim 19 wherein each of the locking mechanisms comprises a locking actuator configured to selectively actuate the first and second locking pawls between the lock-ready position and the unlocked position.

* * * * *